US007516587B2

(12) United States Patent
Barlow

(10) Patent No.: US 7,516,587 B2
(45) Date of Patent: Apr. 14, 2009

(54) INTERLOCKING FLOOR SYSTEM

(76) Inventor: David R. Barlow, 7620 Harborview Way North, Seminole, FL (US) 33776

( * ) Notice: Subject to any disclaimer, the term of this patent is extended or adjusted under 35 U.S.C. 154(b) by 300 days.

(21) Appl. No.: 11/535,805

(22) Filed: Sep. 27, 2006

(65) Prior Publication Data

US 2008/0072514 A1 Mar. 27, 2008

(51) Int. Cl.
*E04B 2/00* (2006.01)
*E04F 15/00* (2006.01)

(52) U.S. Cl. ..... 52/591.2; 52/177; 52/385; 428/192

(58) Field of Classification Search ..... 52/384, 52/385, 390, 391, 392, 177, 311.2, 574, 591.1, 52/591.2, 592.1, 588.1, 589.1; 404/18, 33, 404/35; D25/138; 428/192
See application file for complete search history.

(56) References Cited

U.S. PATENT DOCUMENTS

| | | | | |
|---|---|---|---|---|
| 609,940 | A * | 8/1898 | Koehler | 52/592.1 |
| 841,490 | A * | 1/1907 | Du Montier | 52/591.2 |
| 1,920,920 | A * | 8/1933 | Venzie | 52/483.1 |
| 2,851,134 | A * | 9/1958 | Robinson, Jr. | 52/506.1 |
| 3,077,426 | A * | 2/1963 | Johnston | 181/286 |
| 3,735,988 | A * | 5/1973 | Palmer et al. | 473/162 |
| 6,082,886 | A * | 7/2000 | Stanford | 362/576 |
| 6,647,690 | B1 * | 11/2003 | Martensson | 52/601 |
| 6,793,586 | B2 * | 9/2004 | Barlow et al. | 473/162 |
| D499,189 | S * | 11/2004 | Collison | D25/62 |
| 6,862,857 | B2 * | 3/2005 | Tychsen | 52/582.1 |
| 6,922,965 | B2 * | 8/2005 | Rosenthal et al. | 52/592.1 |
| 6,968,663 | B2 * | 11/2005 | Thiers et al. | 52/589.1 |
| 7,003,924 | B2 * | 2/2006 | Kettler et al. | 52/578 |
| D530,835 | S * | 10/2006 | Rosine et al. | D25/138 |
| 7,299,592 | B2 * | 11/2007 | Moller, Jr. | 52/180 |
| 7,340,865 | B2 * | 3/2008 | Vanderhoef | 52/177 |
| 2002/0083673 | A1 * | 7/2002 | Kettler et al. | 52/578 |
| 2002/0189176 | A1 * | 12/2002 | Stegner et al. | 52/177 |
| 2003/0009971 | A1 * | 1/2003 | Palmberg | 52/578 |
| 2005/0016098 | A1 * | 1/2005 | Hahn | 52/384 |
| 2005/0028475 | A1 * | 2/2005 | Barlow et al. | 52/578 |
| 2005/0066606 | A1 * | 3/2005 | Dolinski | 52/582.2 |
| 2006/0070314 | A1 * | 4/2006 | Jenkins et al. | 52/177 |
| 2006/0272252 | A1 * | 12/2006 | Moller | 52/384 |
| 2006/0283127 | A1 * | 12/2006 | Pervan | 52/592.1 |
| 2007/0163195 | A1 * | 7/2007 | Jenkins et al. | 52/384 |
| 2007/0214741 | A1 * | 9/2007 | Llorens Miravet | 52/592.1 |
| 2007/0289236 | A1 * | 12/2007 | Choi | 52/311.2 |
| 2008/0010928 | A1 * | 1/2008 | Moriau et al. | 52/392 |
| 2008/0092473 | A1 * | 4/2008 | Heyns | 52/385 |

(Continued)

*Primary Examiner*—Robert J Canfield
*Assistant Examiner*—Brent W Herring
(74) *Attorney, Agent, or Firm*—Frank Liebenow; Larson & Larson, P.A.

(57) ABSTRACT

Multiple polymeric panels molded as a rigid integral body having a planar top surface and a bottom grid structure are interlocked together mechanically along side edges. Each side edge has alternating upwardly and downwardly facing steps with concave dimples on one and mating convex projections on the other for securely interlocking adjacent panels to each other. The steps of adjacent panels interlock with each other to form a complete floor system. The multiple polymeric panels can be molded to simulate flooring materials such as brick or overlaid with sections of linoleum, carpet, synthetic grass, tile or wood flooring. Alternately, the assembled panels can be covered with a sheet of decorative material.

20 Claims, 24 Drawing Sheets

U.S. PATENT DOCUMENTS

2008/0127593 A1* 6/2008 Janesky ..... 52/581
2008/0168730 A1* 7/2008 Pervan et al. ..... 52/313
2008/0168736 A1* 7/2008 Pervan ..... 52/586.1

* cited by examiner

INTERLOCKING FLOOR SYSTEM

FIELD OF THE INVENTION

The present invention relates to flooring. More particularly, it refers to multi-sectional interlocking polymeric panels held together by a mechanical locking feature, the panels forming a floor surface or under laying surface.

BACKGROUND OF THE INVENTION

Surface coverings, such as carpet, linoleum, wood flooring, rubberized flooring system, and tile, need to be laid over a base that will support the surface covering. Commonly, surface coverings are laid over a base of plywood or cement. These base materials are expensive to install, and once installed are difficult to remove. Recreational surfaces frequently need to be moved to different locations because the same site may be used for different activities, such as an ice rink converted to a basketball court or concert stage. A need exists for an inexpensive, easily movable base surface as a stand-alone floor surface or for use in conjunction with multiple surface coverings.

US Pub. No. 2005-0028475-A1 to Barlow describes an "Interlocked Base and an Overlaying Surface Covering," and is hereby incorporated by reference. This application describes polymeric panels that can be used to quickly cover or create surfaces such as a concert floor over an ice rink, a stage, or a backyard patio. The panels described in this application can not always guarantee positive horizontal alignment between adjacent panels. Furthermore, the design of such panels precludes making panels that, when mated together, have straight interface lines such as those in prevalent sidewalk construction.

SUMMARY OF THE INVENTION

The invention of this application is a multiplicity of one piece sectional polymeric panels attachable by locking features to adjacent panels in various directions to create an indoor/outdoor floor system. The multiple polymeric panels are prepared by compression, blow, injection, or any other molding process to prepare a planar top surface integral with a bottom grid structure. Locking features are mounted at an end of each panel juxtaposed to an adjacent polymeric panel. The interlocked panels can be easily disassembled and moved to a different location.

It is an objective of the present invention to provide panels that can easily be assembled into a flooring or sub-floor system without the use of tools.

Another objective of the present invention is to provide panels that when no longer needed, can be disassembled and reused at a later time.

Another objective of the present invention is to provide panels that have decorative top surfaces and are ready to be used to create floors or patio areas.

In one embodiment, polymeric panels are disclosed including a rigid integral body having a planar top surface and a grid structure supporting the top surface and multiple interlocking side surfaces. Each interlocking side surface has upwardly and downwardly facing steps with the downwardly facing steps having a convex projection on a bottom surface and the upwardly facing steps having a concave mating dimple on an upper surface. An over hang ledge is formed as an extension of the planar top surface, thereby forming a cavity between the over hang ledge and the upper surface of the upwardly facing step. An under hang ledge is formed in a top surface of the downwardly facing steps allowing the downward facing steps of a first panel to fit within the cavity of a second panel. The steps of the side surfaces of the first panel interlock to complementary steps of the second panel.

In another embodiment, a flooring system is disclosed including multiple of one piece sectional molded rigid polymeric panels, each with at least one downwardly facing step and at least one upwardly facing step in a side surface, a planar top surface, and a grid structure supporting the top surface. At least one of the at least one downwardly facing steps has a convex projection on a bottom surface and at least one of the at least one upwardly facing steps has a concave mating dimple on an upper surface. An over hang ledge is formed as an extension of the planar top surface forming a cavity between the over hang ledge and the upper surface of the upwardly facing step and an under hang ledge formed in a top surface of the downwardly facing step. This allows for the downward facing step of a first panel to snuggly fit within the cavity of a second panel so that the steps of the side surfaces of the first panel interlock to complementary steps of the second panel and the adjacent panels retain planar alignment.

In another embodiment, an interlocked floor is disclosed including multiple polymeric panels molded as a rigid integral body with a planar top surface and a grid structure supporting the top surface and multiple interlocking side surfaces. Each interlocking side surface has upwardly and downwardly facing steps, at least one of the downwardly facing steps with convex projections on a bottom surface and at least one of the upwardly facing steps with concave mating dimples on an upper surface. An over hang ledge extends from the planar top surface and forms a cavity between the over hang ledge and the upper surface of the upwardly facing step while an under hang ledge formed in a top surface of the downwardly facing step. This allows for the downward facing step of a first panel to fit within the cavity of a second panel and the steps of the side surfaces of the first panel interlock with complementary steps of the second panel.

BRIEF DESCRIPTION OF THE DRAWINGS

The invention can he best understood by those having ordinary skill in the art by reference to the following detailed description when considered in conjunction with the accompanying drawings in which.

DETAILED DESCRIPTION OF THE INVENTION

Figure 1:
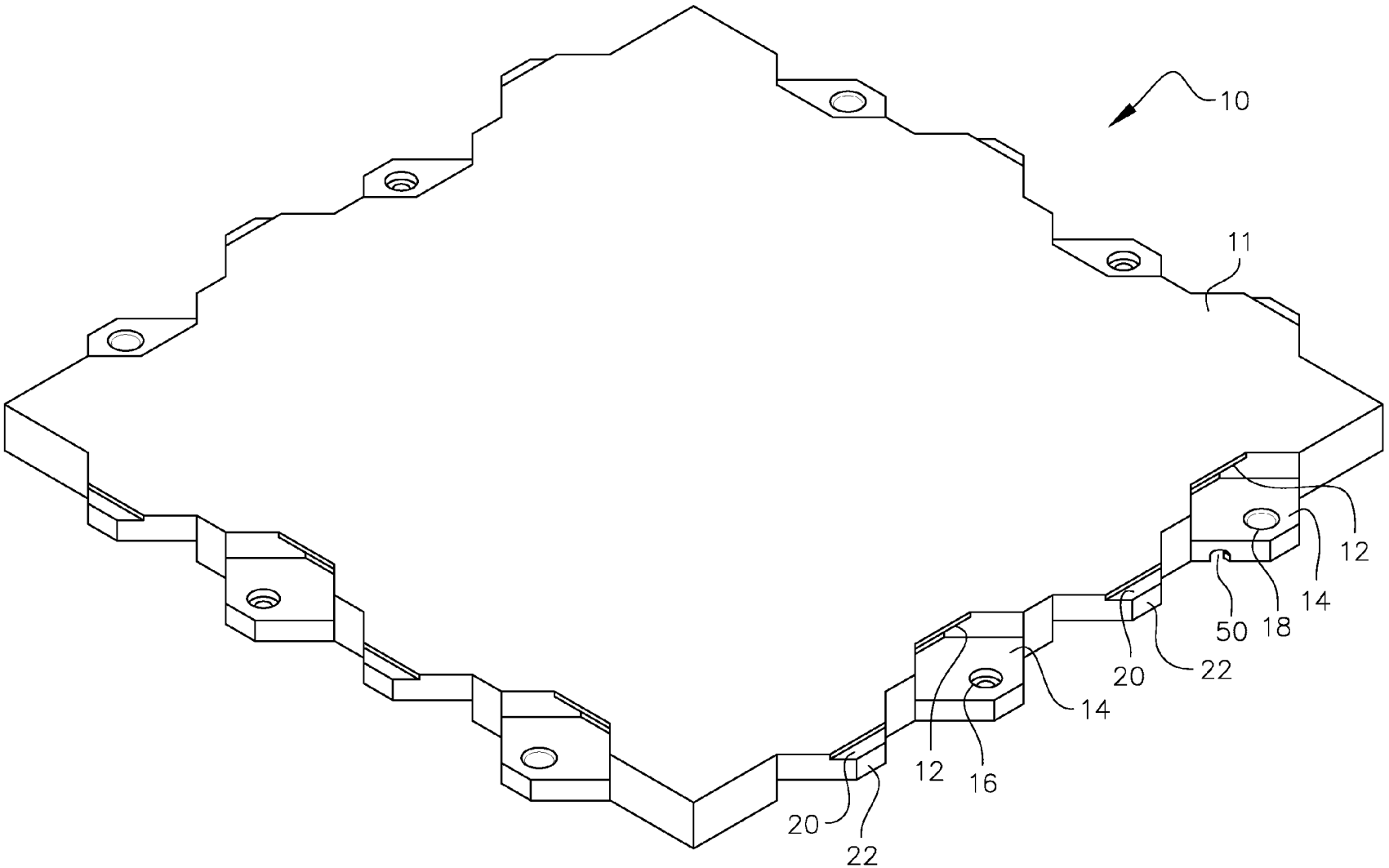
FIG. 1 is a top perspective view of a molded polymeric panel employed to form the interlocked base or floor system.

Throughout the following detailed description the same reference numerals refer to the same elements in all figures.

Figure 8:
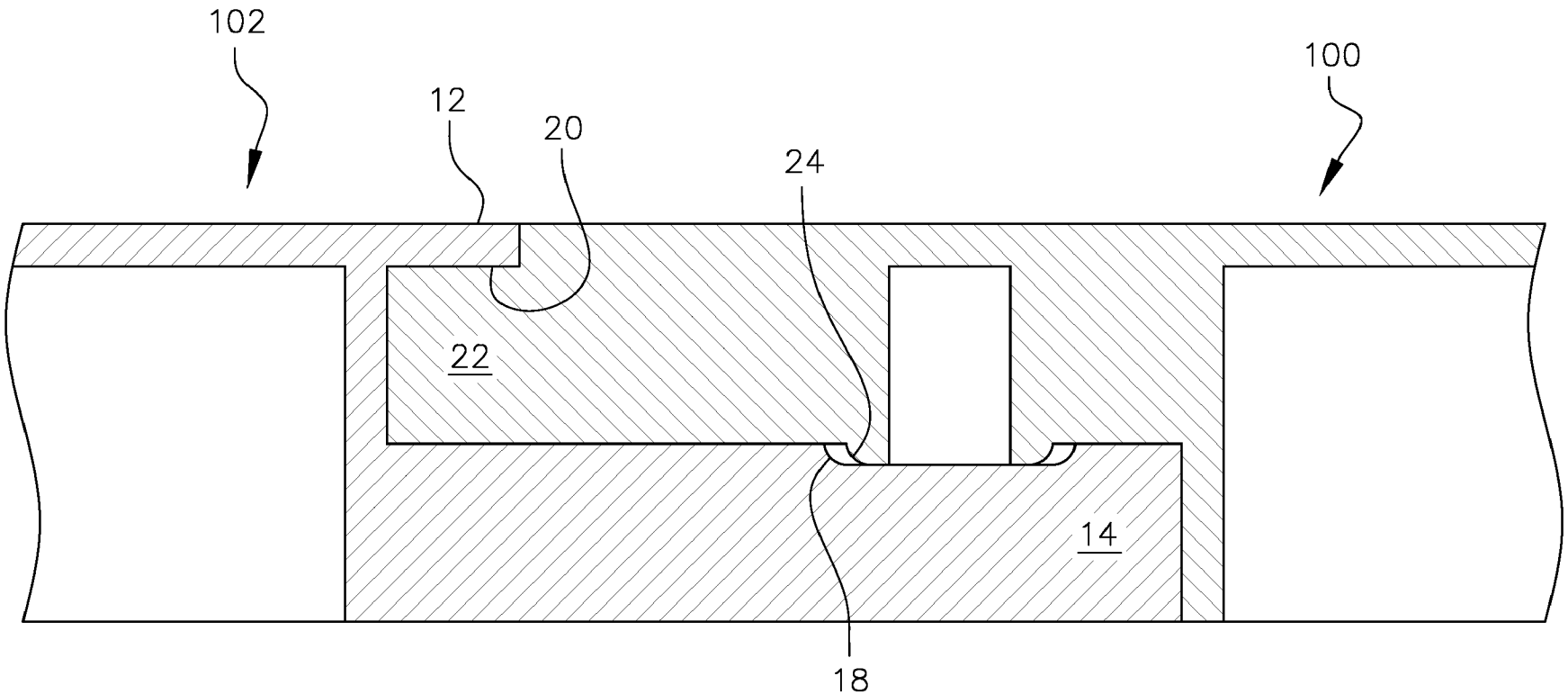
FIG. 8 is a cross-section along line 8-8 of FIG. 3 showing the adjacent polymeric edges in the panels interlocked together.
Figure 8A:
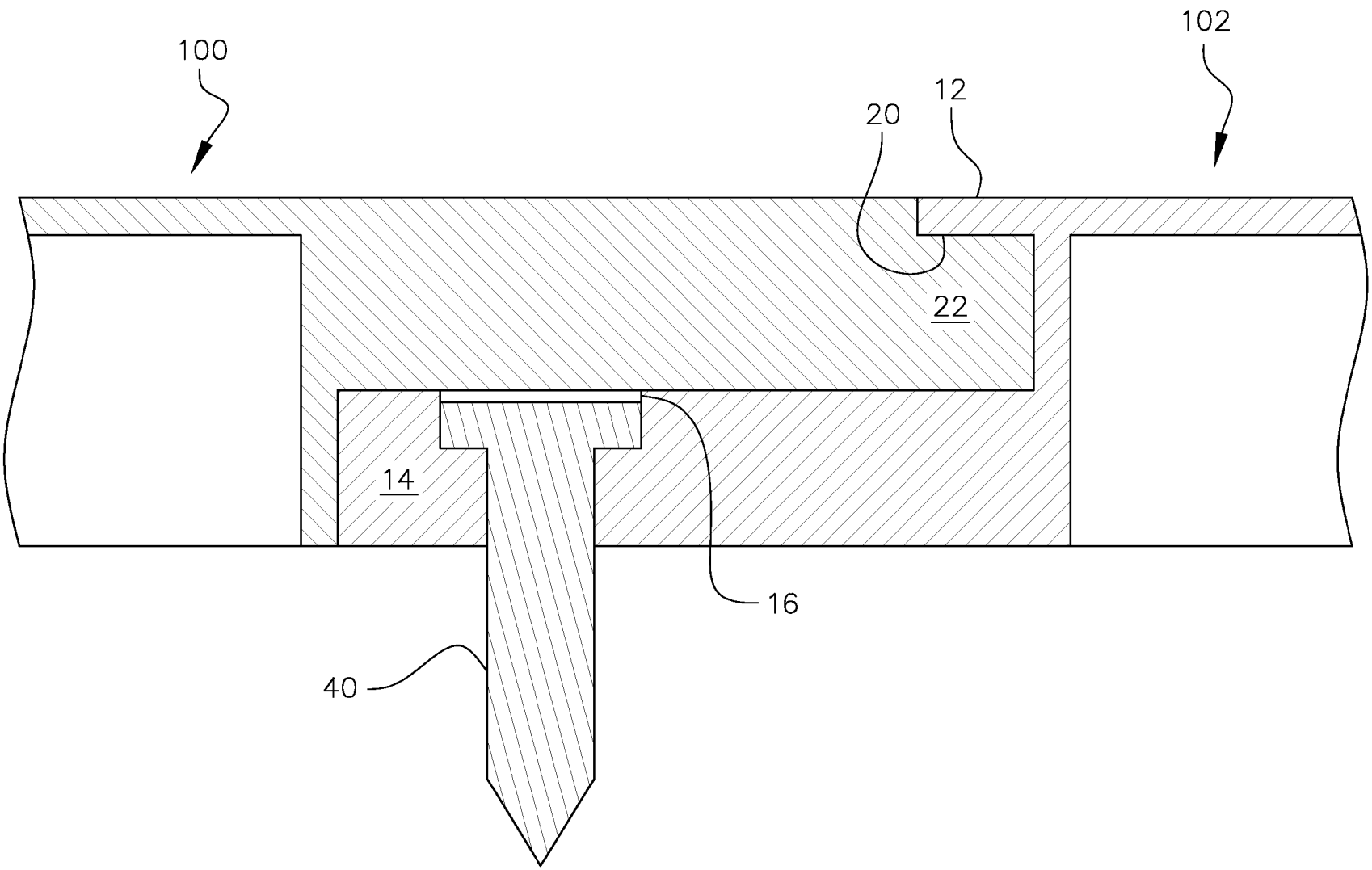
FIG. 8A is a cross-section along line 8A-8A of FIG. 3 showing the adjacent polymeric edges in the panels interlocked together and held to the subsurface with a spike or screw.

Referring to FIGS. 1, 2, 8 and 8A, panels 100/102 join together to form an interlocked series of panels arranged to be mechanically interlocked together. Each panel 10 has a planar top surface 11 and each panel 10 has upward facing steps 14 and downward facing steps 22. At least one of the downward facing steps 22 contains a downwardly pointing convex projection 24 on their lower surfaces as shown in FIG. 8. At least one of the upward facing steps 14 contains a concave mating dimple 18 on their upper surface. An under hang ledge 20 is provided to allow the downward facing steps 22 to be inserted with the under hang ledge 20 sliding into a cavity formed between the upward facing steps 14 and an overhang ledge 12, thereby engaging the convex projections 24 with concave dimples 18. The overhang ledge is a continuation of the planar top surface 11 of the panel 10. Such an interlock mechanism helps adjacent panels retain planar alignment while providing a tight mechanical interlock.

In embodiments with panels that have more than one pair of steps, it is preferred to configure the panels 10 as shown alternating the upward facing steps with the downward facing steps and with the outer steps 14/22 having the mating convex projections 24 and concave mating dimples 18. In an alternate embodiment, the upward facing steps are in a different order and do not alternate with the downward facing steps.

In some embodiments where the panels are smaller, a single pair of steps 14/22 is sufficient. In some embodiments where the panels are larger, several pair of steps 14/22 is included and more than one pair of steps includes the mating convex projections 24 and concave mating dimples 18.

The panels 10 can be disengaged by pulling them apart. In a preferred embodiment, the top planar surface 11 of the panel 10 is molded as an integral rigid body with the grid structure 25 shown in FIG. 7. In some embodiments, the top planar surface 11 is coated with a surface material such as carpet, linoleum, vinyl, wood, synthetic wood, ceramic tile, plastic tile, artificial turf, etc. In some embodiments, the top planar surface 11 is not coated and an area cover is affixed after the planar panels 10 are installed.

In some embodiments, one or more of the upwardly facing steps 14 include a secondary countersunk hole 16 for accepting an anchor fastener such as a screw or spike 40 without interfering with the interlocking action. It can be seen in FIG. SA that the screw or spike 40 can hold the polymeric panels 100/102 to a sub floor or the ground.

Additionally, in some embodiments, a wire chase 50 is cut or molded into the sub structure of the panels 10 to permit a wire to run between the panels 10 and a sub floor (not shown).

The molded integral rigid body with grid structure 25 is made from molded filled or non-filled polymers or any other suitable material including rubber, recycled rubber or any rubber-like material. The polymers can include polypropylene, structural urethane foams or other suitable commercially available polyolefins. The rubber can include structural foam and processed recycled automobile tires mixed in a bonding agent.

Figure 2:
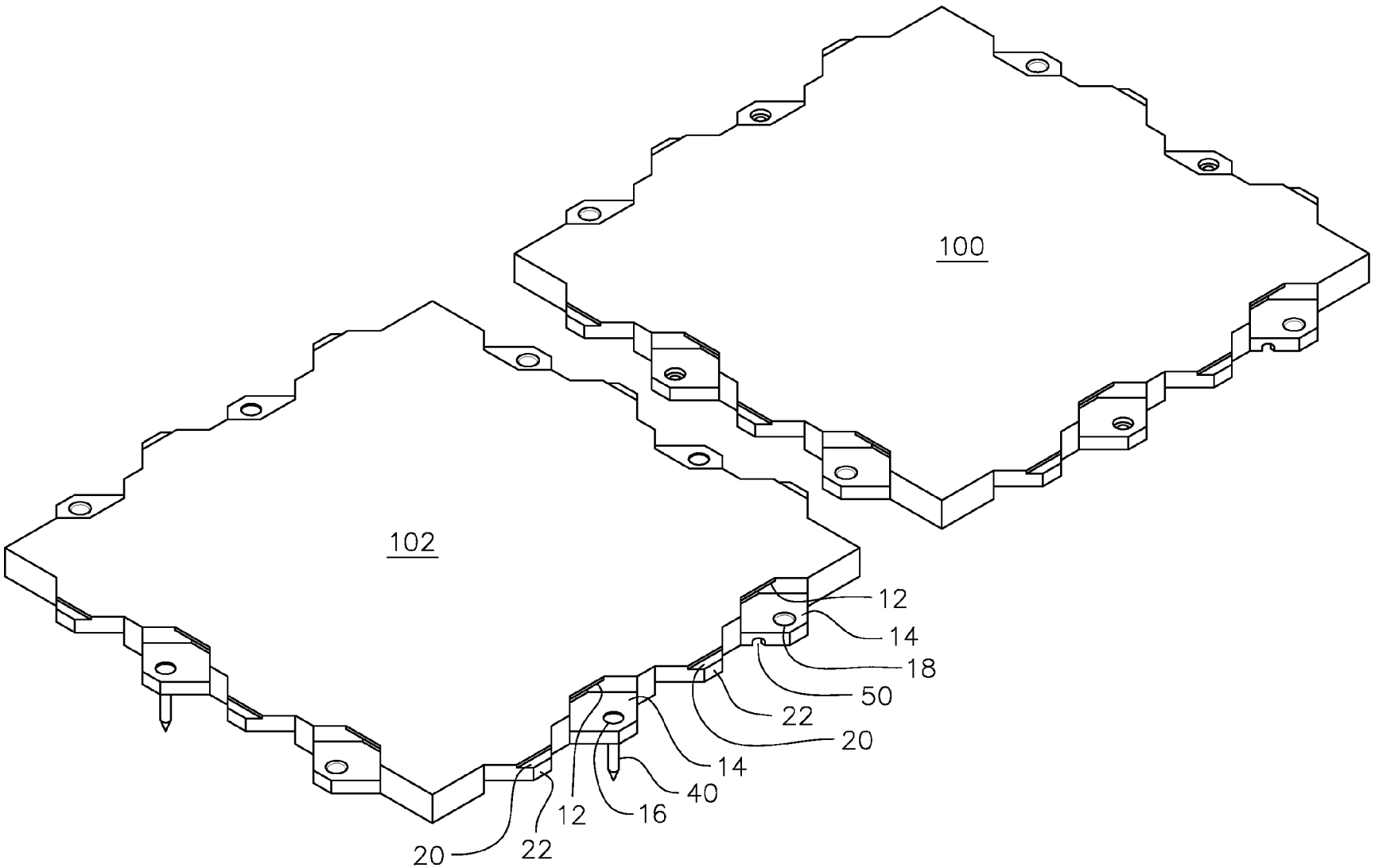
FIG. 2 is a top perspective view of two adjacent polymeric panels of FIG. 1 ready to be interlocked together at their edges.
Figure 3:
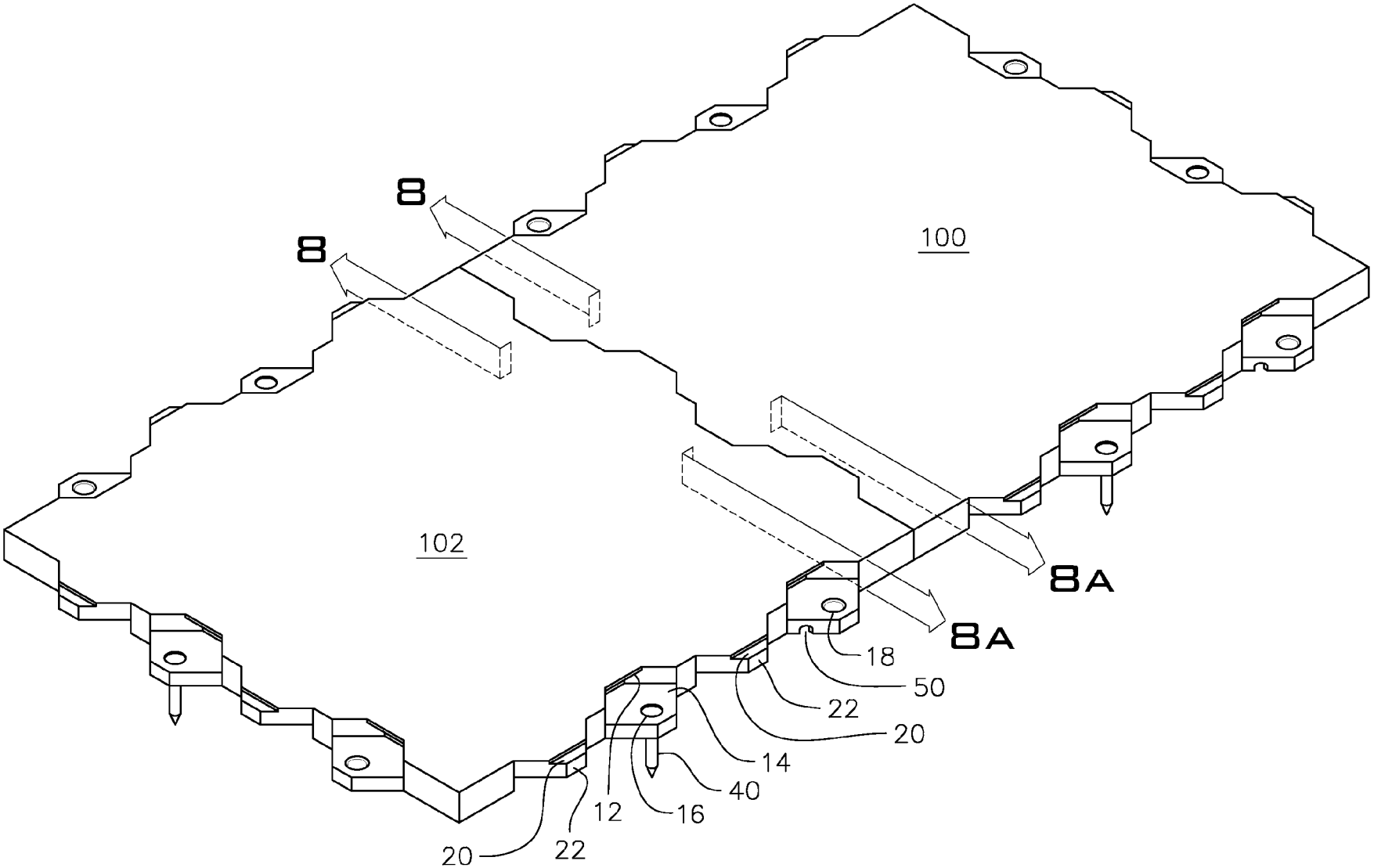
FIG. 3 is a top perspective view of two adjacent polymeric panels of FIG. 1 interlocked together at their edges.

Referring to FIGS. 2 and 3, two adjacent polymeric panels 10 of FIG. 1 are shown prior to being interlocked together (FIG. 2) and shown interlocked (FIG. 3). The panels 100/102 are pushed together until the concave dimples 18 mate with the convex dimples 24.

In some embodiments, for added stability, a spike or screw 40 is inserted into a secondary recessed bore 16 below one of both of the recessed dimples 18.

Figure 4:
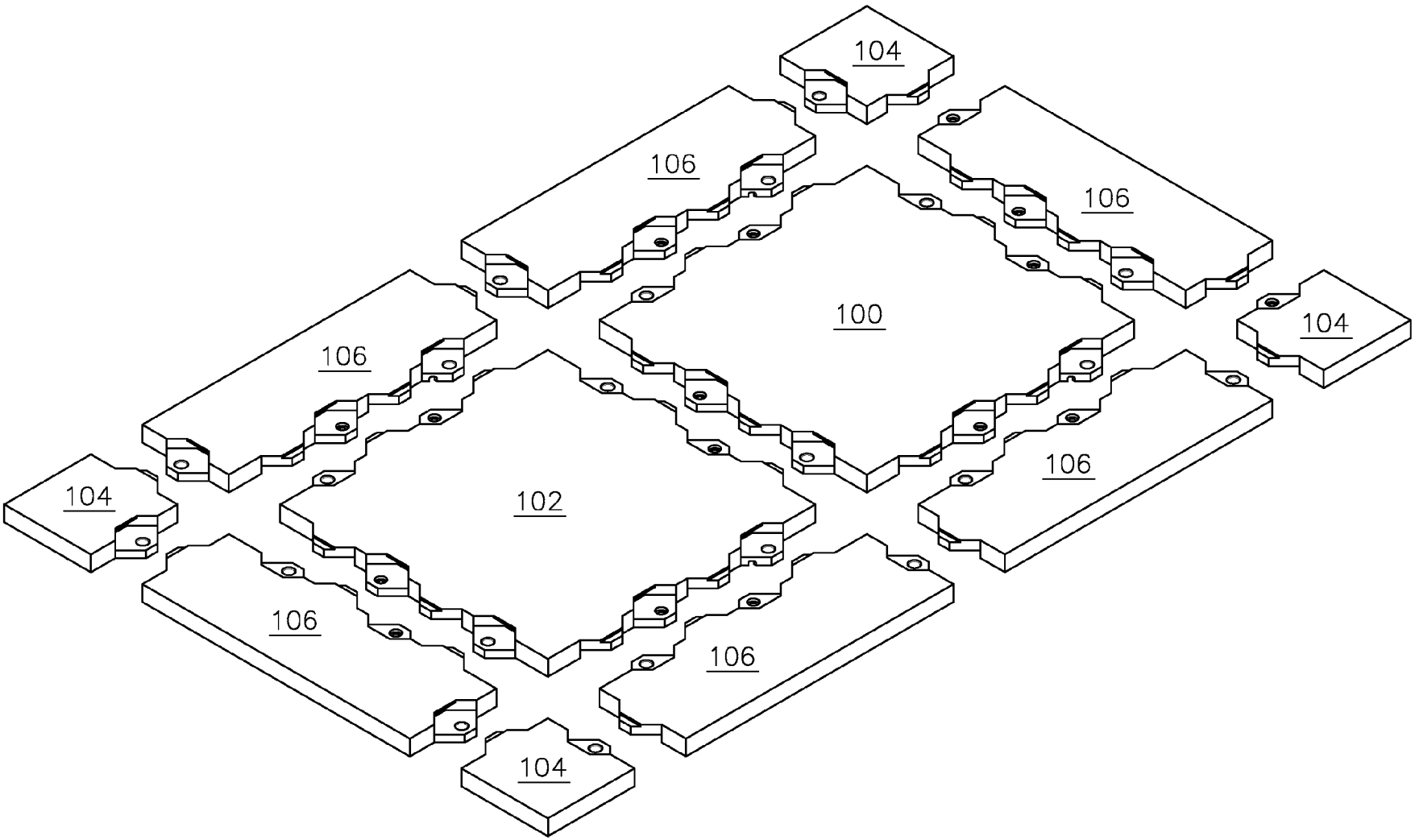
FIG. 4 is a top perspective view of two adjacent polymeric panels of FIG. 1 and flat-edged border panels ready to be interlocked together at their edges.
Figure 5:
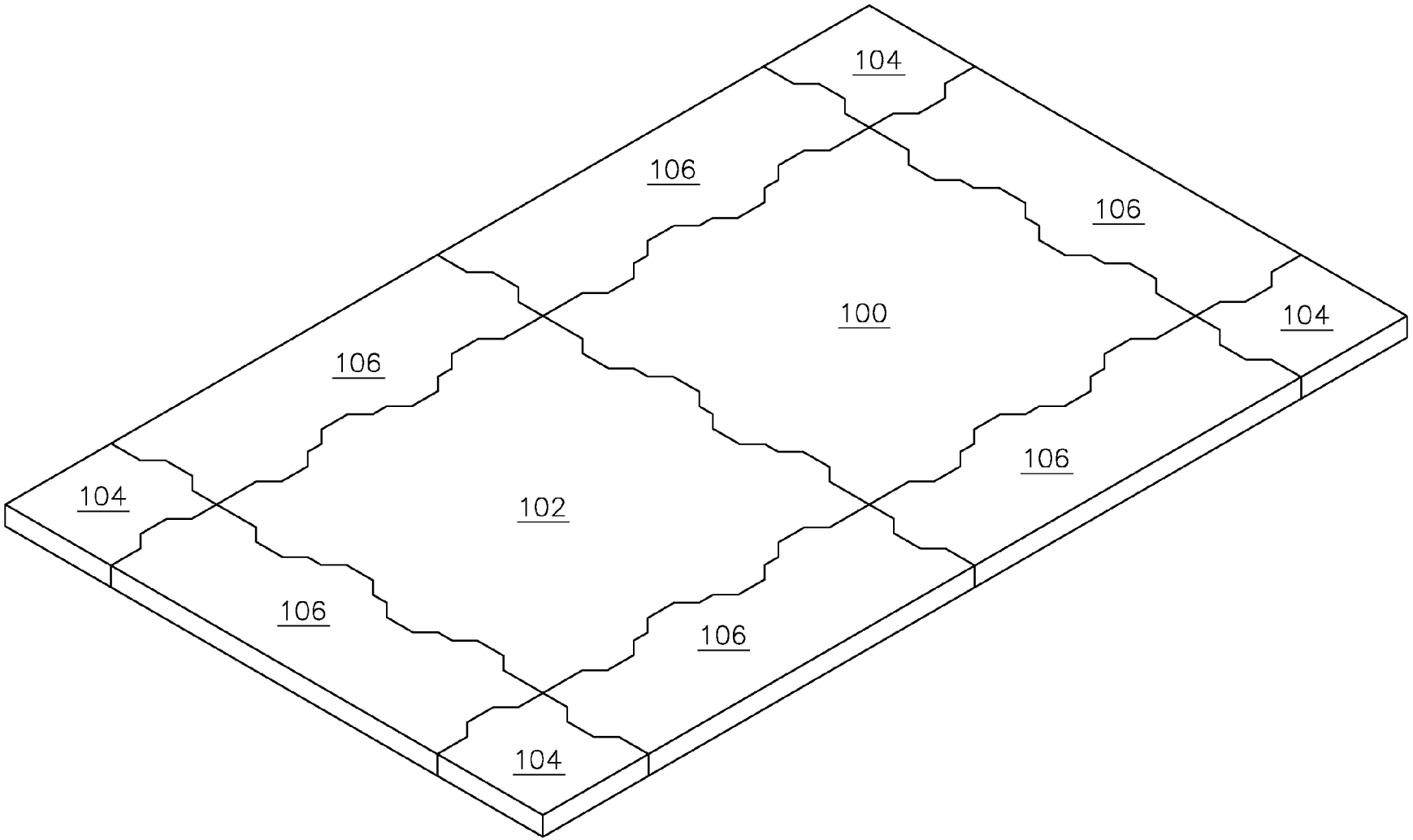
FIG. 5 is a top perspective view of two adjacent polymeric panels of FIG. 1 and flat-edged border panels interlocked together at their edges.

In FIG. 4, two adjacent polymeric panels 100/102 of FIG. 2 are shown prior to being interlocked and shown interlocked in FIG. 5. In this embodiment, the panels 100/102 mate with edge panels 106 and corner panels 104. The edge panels 106 and corner panels 104 have flat or smooth outward facing edges and the same interlock mechanism as the polymeric panels 100/102. The panels 100/102/104/106 are pushed together until the concave dimples 18 mate with the convex dimples 24.

Figure 6:
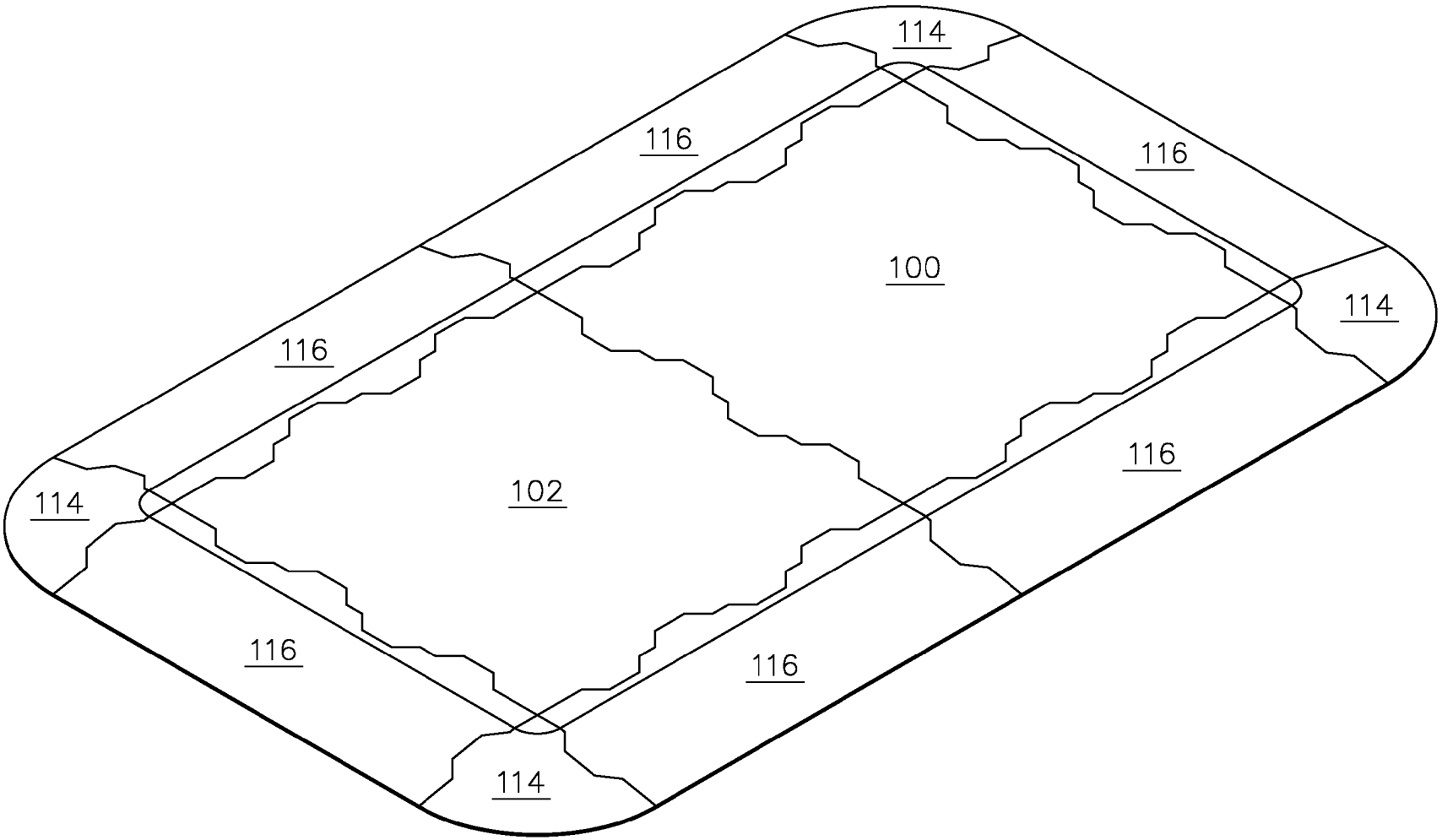
FIG. 6 is a top perspective view of two adjacent polymeric panels of FIG. 1 and round-edged border panels interlocked together at their edges.

Referring to FIG. 6, two adjacent polymeric panels 100/102 of FIG. 1 are interlocked with and round-edged border panels 114/116. The border panels 114/116 of this embodiment have straight (116) or curved edges (114) that taper away from the two polymeric panels 100/102 so as to reduce the chances of tripping over an abrupt edge. In this embodiment, there are side parts 116 that have the same interlock mechanism as the polymeric panels 100/102 to mate directly with the polymeric panels 100/102. The corner parts 114 mate with the side parts 116 in a similar fashion.

Figure 7:
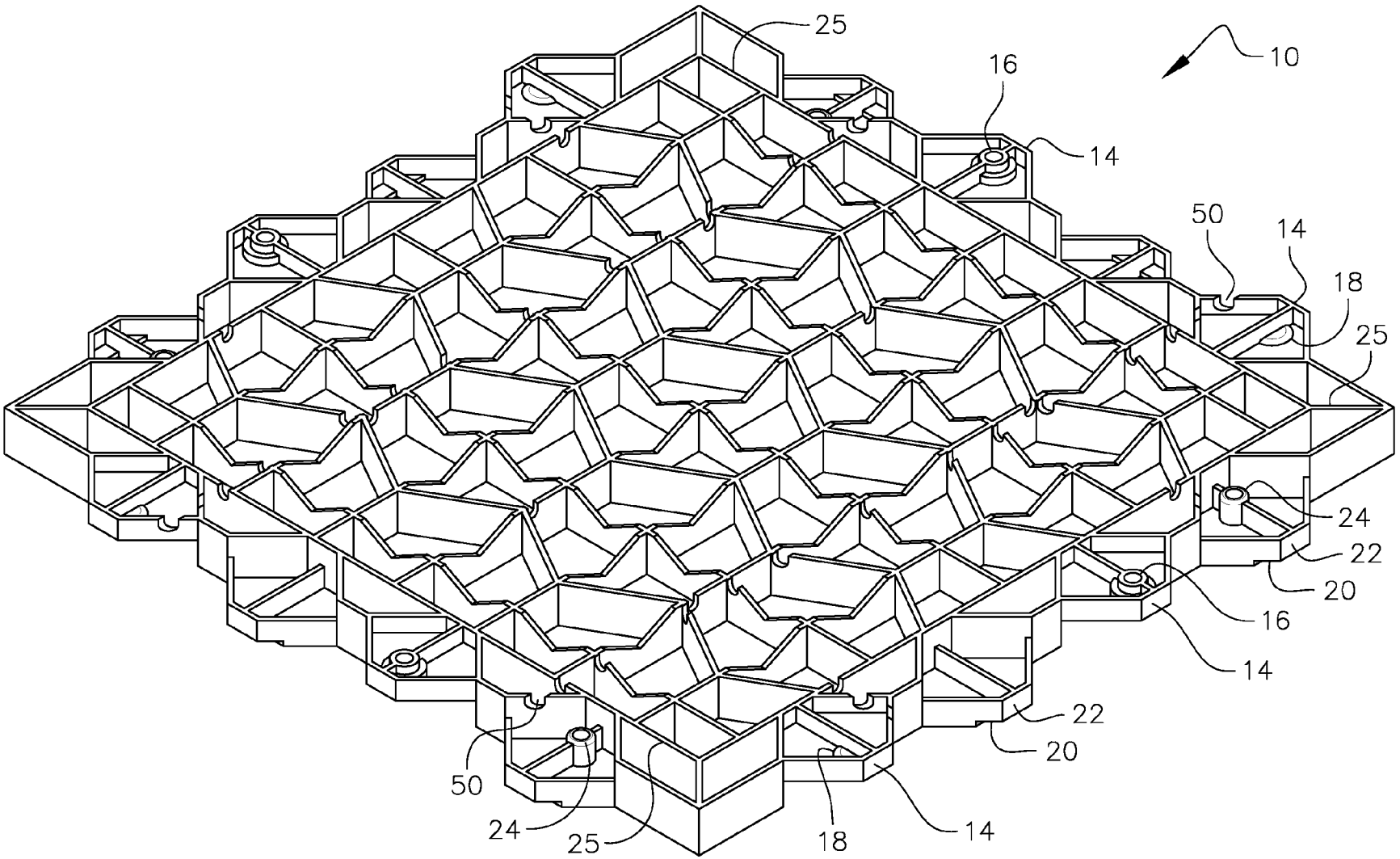
FIG. 7 is a bottom perspective view of a molded polymeric panel shown in FIG. 1.

FIG. 7 shows a bottom perspective view of a molded polymeric panel 10 with a rigid grid structure 25. It is preferred to fabricate the panels with such a grid structure 25, providing strength and durability while keeping weight and material content to a minimum. It is anticipated that other substructures can be substituted without veering from the present invention, including a solid base, honeycombs, etc. In some embodiments, a wire chase 50 is provided to permit running wires and cables between the polymeric panels 10 and a sub floor (not shown). The wire chase 50 is a series of openings allowing a wire to pass under the grid structure 25 of the polymeric panels 10 without creating unevenness, bumps or damage to the wire.

Figure 9:
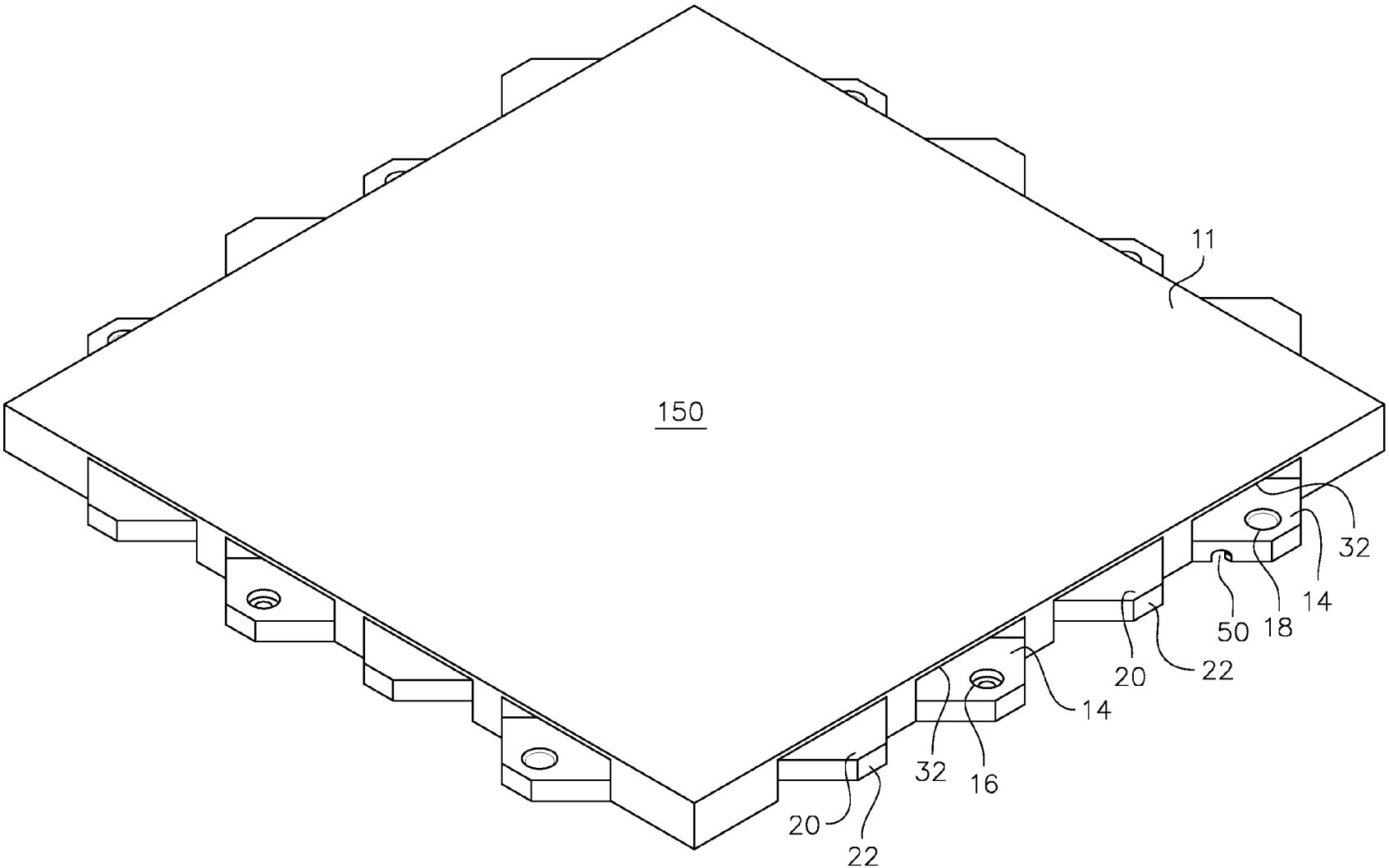
FIG. 9 is a top perspective view of a molded polymeric panel with straight interface edges employed to form the interlocked base or floor system.
Figure 10:
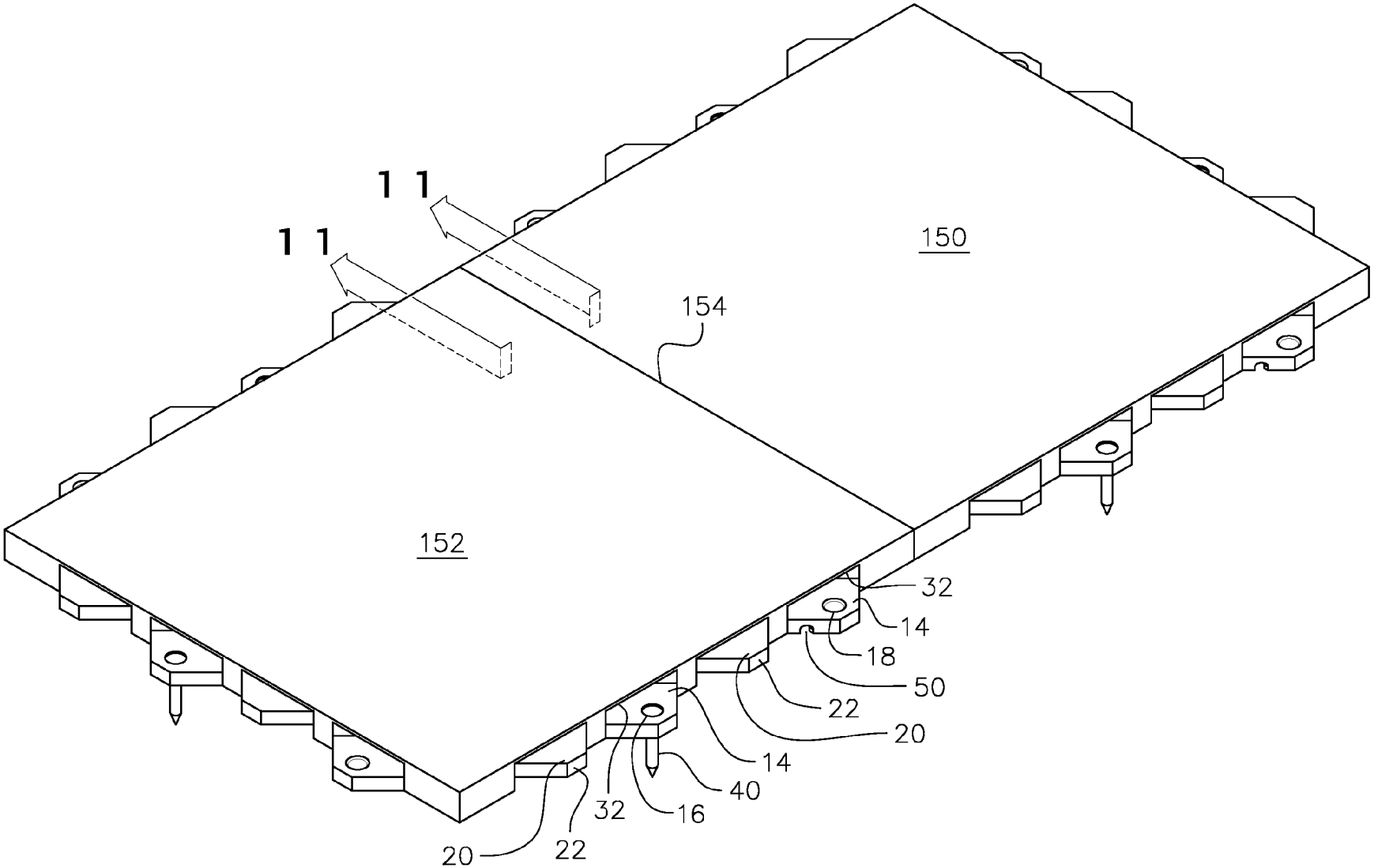
FIG. 10 is a top perspective view of two adjacent polymeric panels of FIG. 9 interlocked together at their edges.
Figure 11:
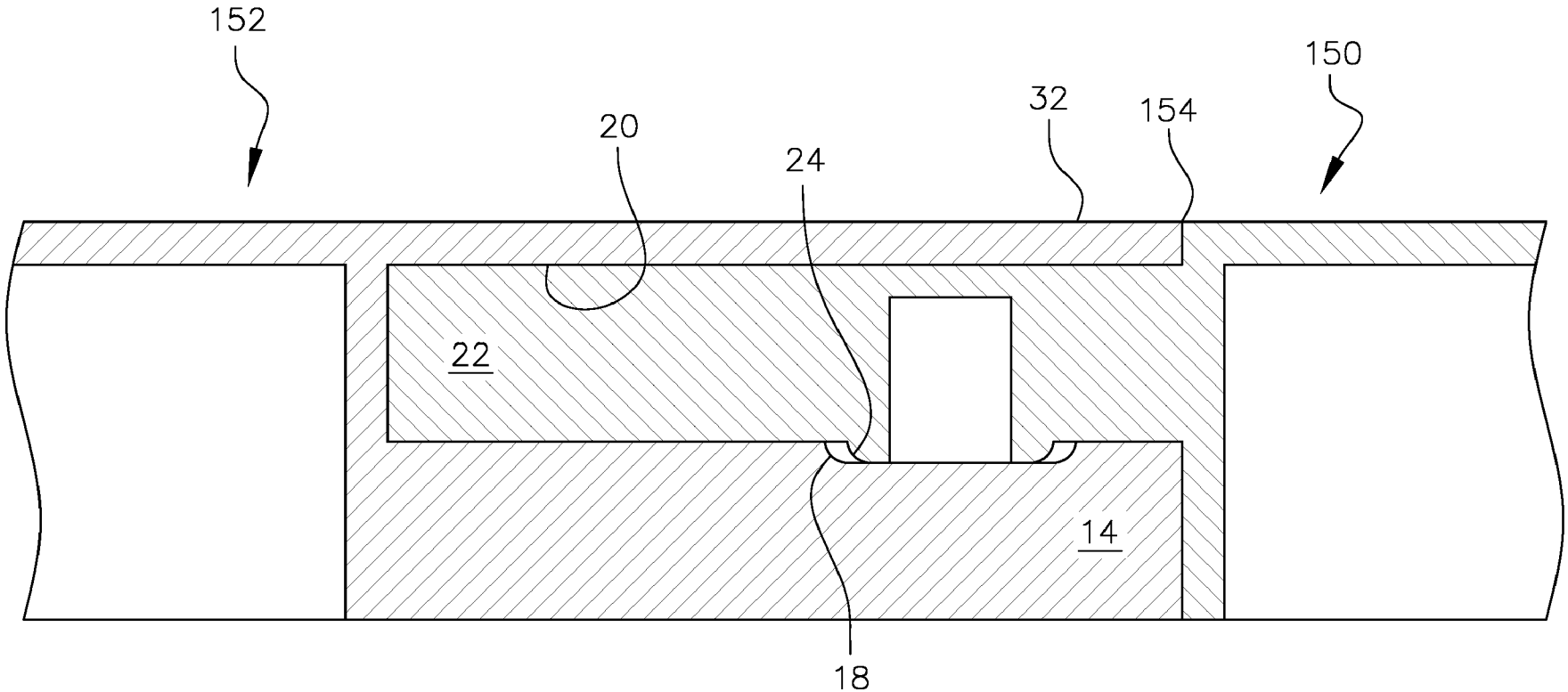
FIG. 11 is a cross-section along line 11-11 of FIG. 10 showing the adjacent polymeric edges in the panels interlocked together.

Referring to FIGS. 9, 10 and 11, panels 150 of a second embodiment join together to form an interlocked series of panels. In this embodiment, the overhang ledge 32 is extended outward from the panel 150 to form a straight edge. Therefore, when joined with other panels 150/152, the interface edge 154 is straight. In this embodiment, the under hang ledge 20 runs the full length of the downward facing step 22. Each panel 150 has upright facing steps 14 and downward facing steps 22. At least one of the downward facing steps 22 contains a downwardly pointing convex projection 24 on lower surface 22. At least one of the upward facing steps 14 contains a mating concave dimple 18 on its upper surface, as shown in FIG. 11. The overhang ledge 32 as shown in FIG. 11 extends outwardly to approximately the same point as the upward facing step 14. The adjacent panels 150/152 are slid together, inserting the downward facing steps 22 between the upward facing steps 14 and the overhang ledge 32, thereby engaging convex projections 24 with concave dimples 18. FIG. 10 shows two panels 150/152 interlocked. The interlock mechanism including the steps, cavities, convex protrusions and concave mating dimples help adjacent panels retain smooth planar alignment with each other in addition to a tight mechanical interlock.

The panels 150/152 can be disengaged by pulling them apart. In a preferred embodiment, the top planar surface 11 of the panel 150 is molded as an integral rigid body with the grid structure 25 shown in FIG. 7.

In embodiments with panels that have more than one pair of steps, it is preferred to configure the panels 150 as shown with the outer steps 14/22 having the mating convex projections 24 and concave mating dimples 18. In some embodiments where the panels are smaller, a single pair of steps 14/122 is sufficient. In some embodiments where the panels are larger, several pair of steps 14/22 is included and more than one pair of steps includes the mating convex projections 24 arid concave mating dimples 18.

As in the previous embodiments, the molded integral rigid body with grid structure 25 is made from molded filled or non-filled polymers or any other suitable material including rubber, recycled rubber or any rubber-like material. The polymers can include polypropylene, structural urethane foams or other suitable commercially available polyolefins. The rubber can include processed, recycled automobile tires mixed in a bonding agent.

Figure 12:
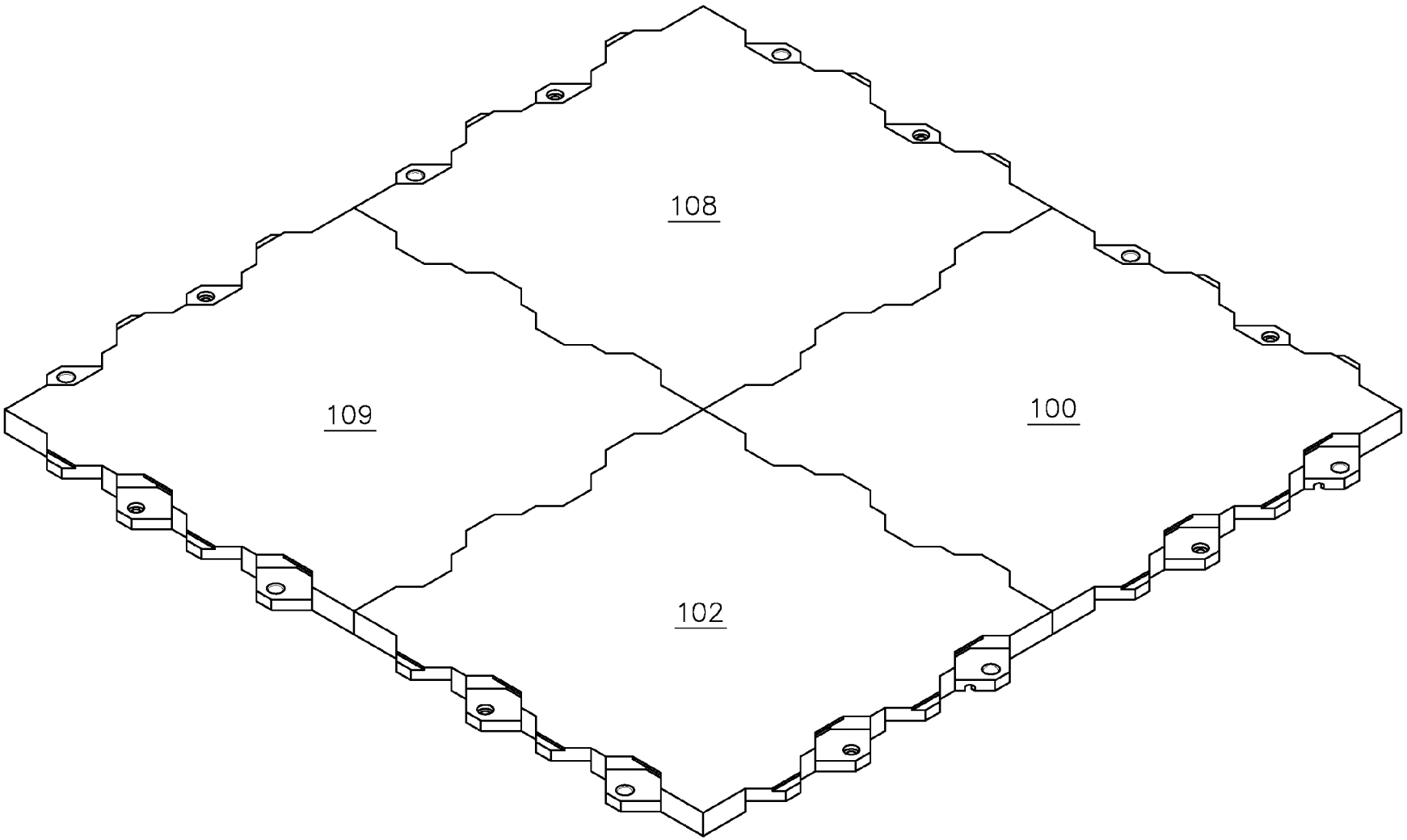
FIG. 12 is a top perspective view of four adjacent polymeric panels of FIG. 1 interlocked together at their edges.

FIG. 12 shows four adjacent polymeric panels 100/102/108/109 of FIG. 1 interlocked together as described in FIGS. 10 and 11.

Figure 13:
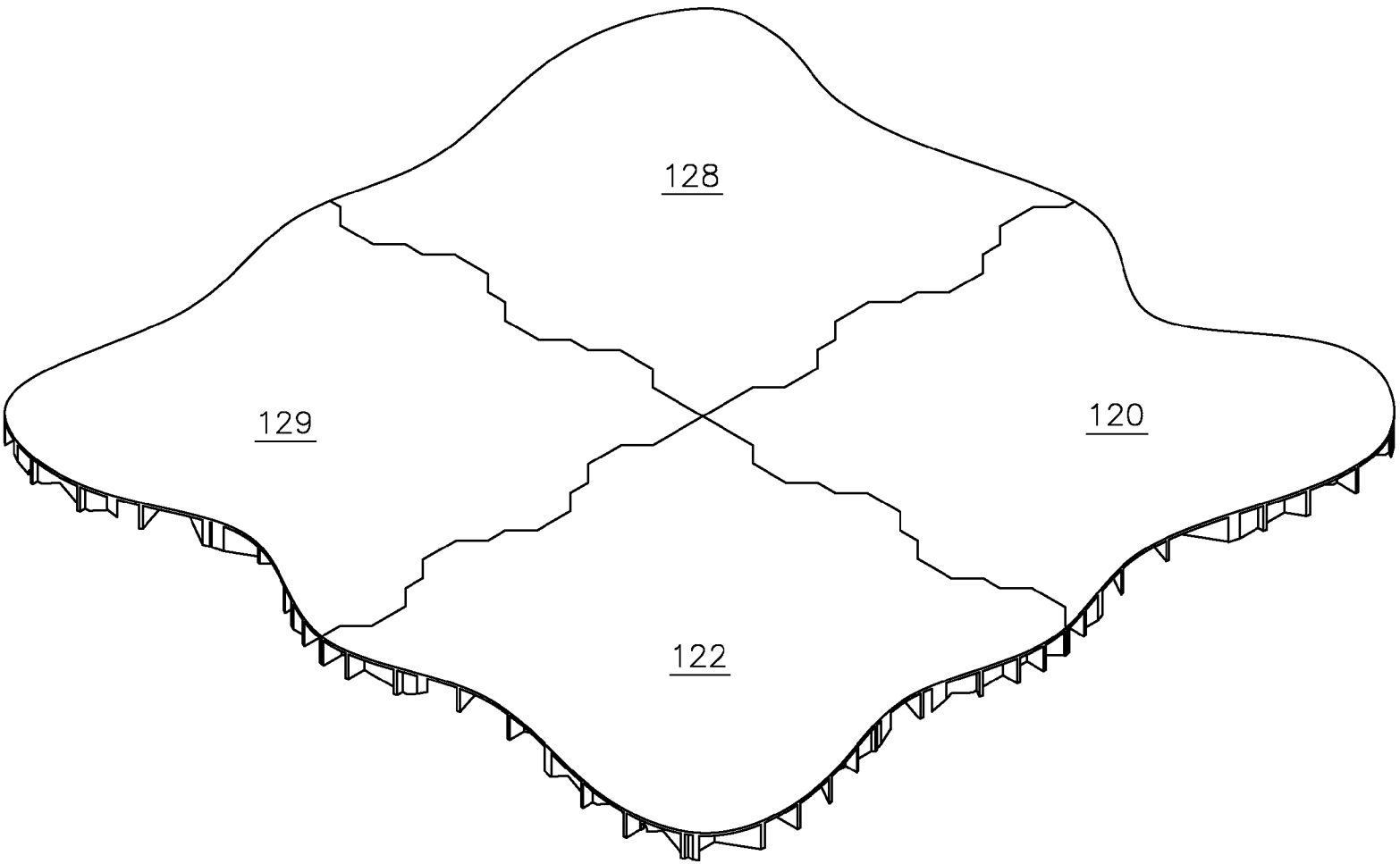
FIG. 13 is a top perspective view of four adjacent polymeric panels with curved outer edges interlocked together at their edges.

FIG. 13 shows four adjacent polymeric panels with curved outer edges 120/122/128/129 interlocked together as described above. These panels 120/122/128/129 are either fabricated with smooth or curved outer edges or are cut to shape during installation.

Figure 14:
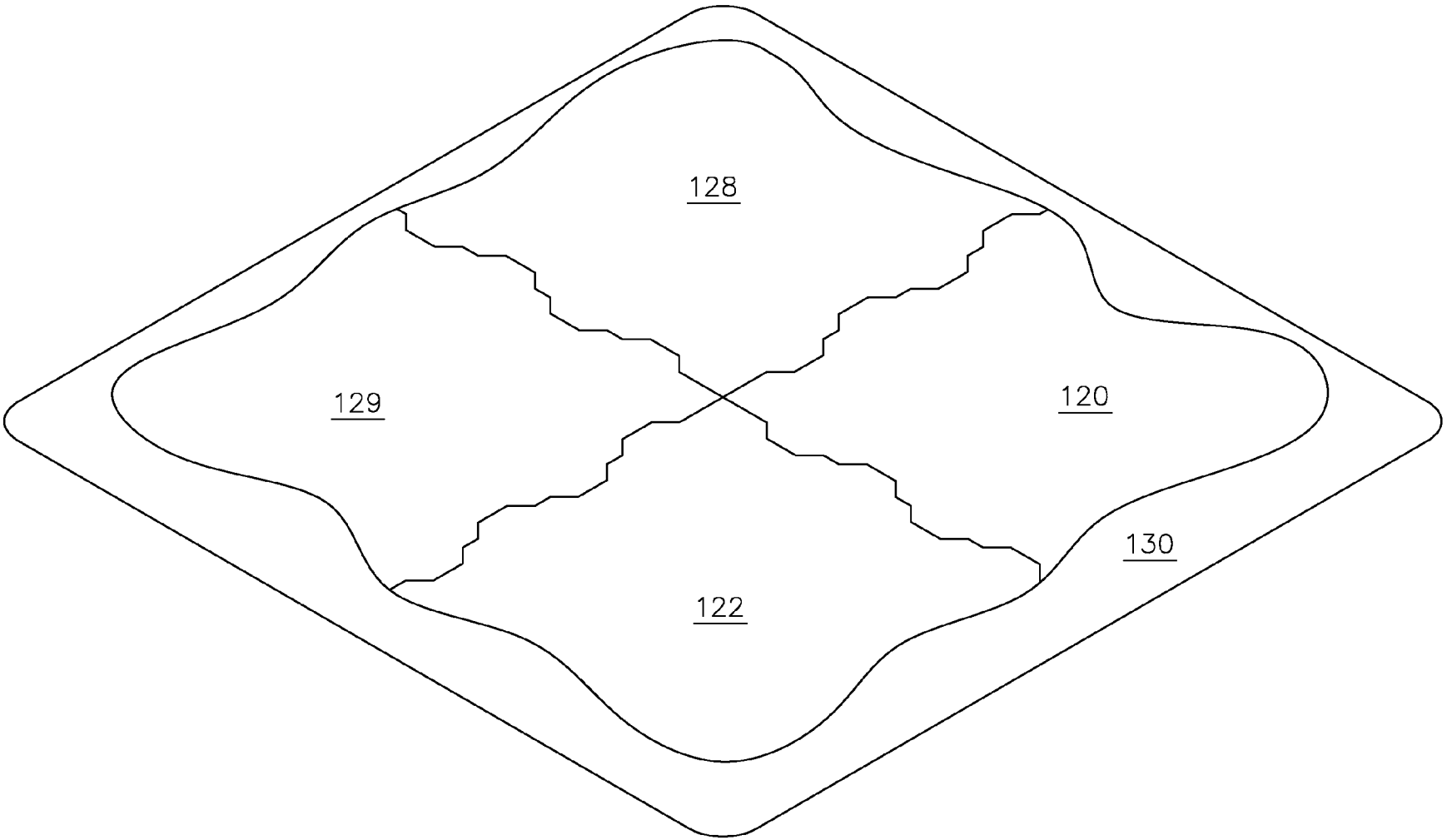
FIG. 14 is a top perspective view of four adjacent polymeric panels of FIG. 13 interlocked together at their edges enclosed within a border.

FIG. 14 shows four adjacent polymeric panels with curved outer edges 120/122/128/129 interlocked together as described above enclosed within a border 130. The border 130 is, for example, a molded border shaped to the contour of the outer edges of the curved panels 120/122/128/129, or an area of sand, dirt or concrete that is backfilled around the panels 120/122/128/129 as in a patio arrangement.

Figure 15A:
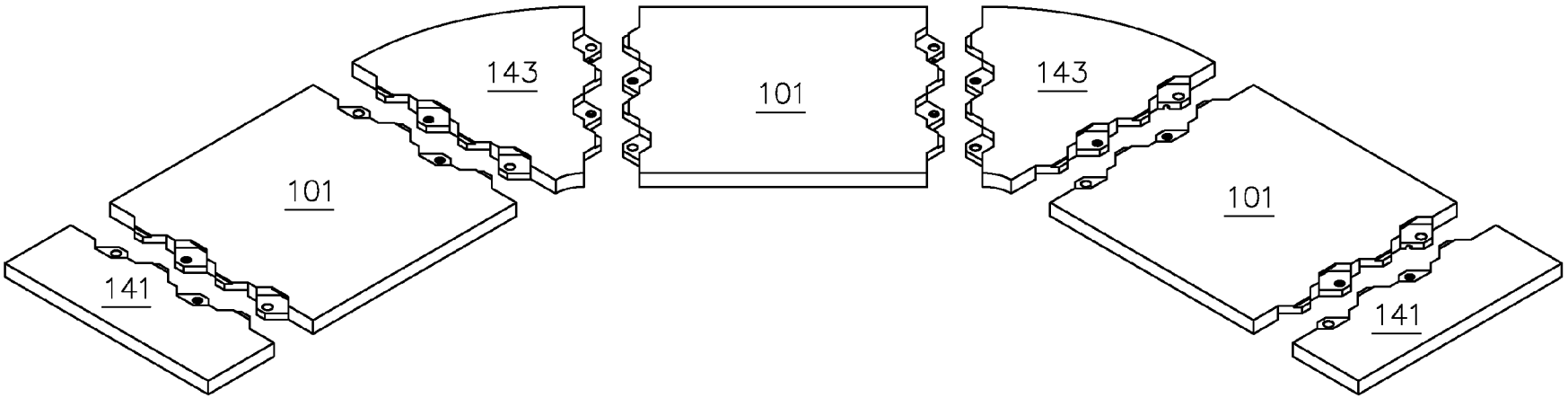
FIG. 15A is a top perspective view of polymeric panels customized to form a sidewalk, ready to be interlocked together at their edges.

FIG. 15A shows the basic interlock mechanism of FIG. 1 with polymeric panels 101/141/143 customized to form a sidewalk. These panels 101/141/143 have the interlock mechanism of the present invention at one side or two opposing sides and have smooth straight or curved edges on the remaining sides. Multiple panels 101/141/143 can be arranged to provide various lengths and configurations of walkways or sidewalks.

Figure 15B:
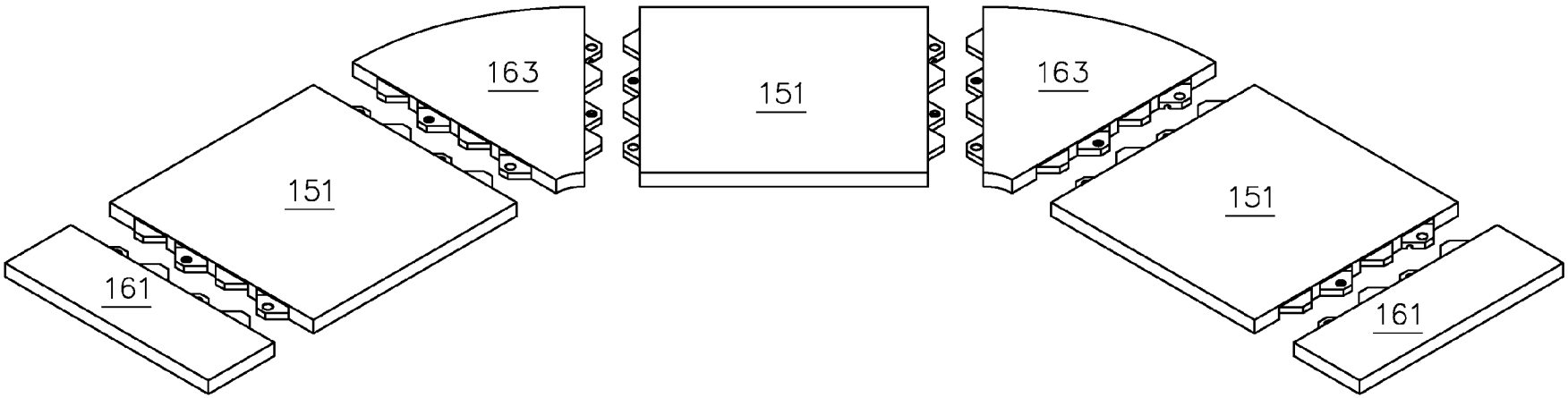
FIG. 15B is a top perspective view of polymeric panels with flat interfacing edges customized to form a sidewalk, ready to be interlocked together at their edges.

FIG. 15B shows the basic interlock mechanism of FIG. 9 with polymeric panels 151/161/163 customized to form a sidewalk with straight interface lines. These panels 151/161/163 have the interlock mechanism of the second embodiment of the present invention (FIG. 9) at one side or two opposing sides and have smooth straight or curved edges on the remaining sides. Multiple panels 151/161/163 can be arranged to provide various lengths and configurations of walkways or sidewalks.

Figure 16A:
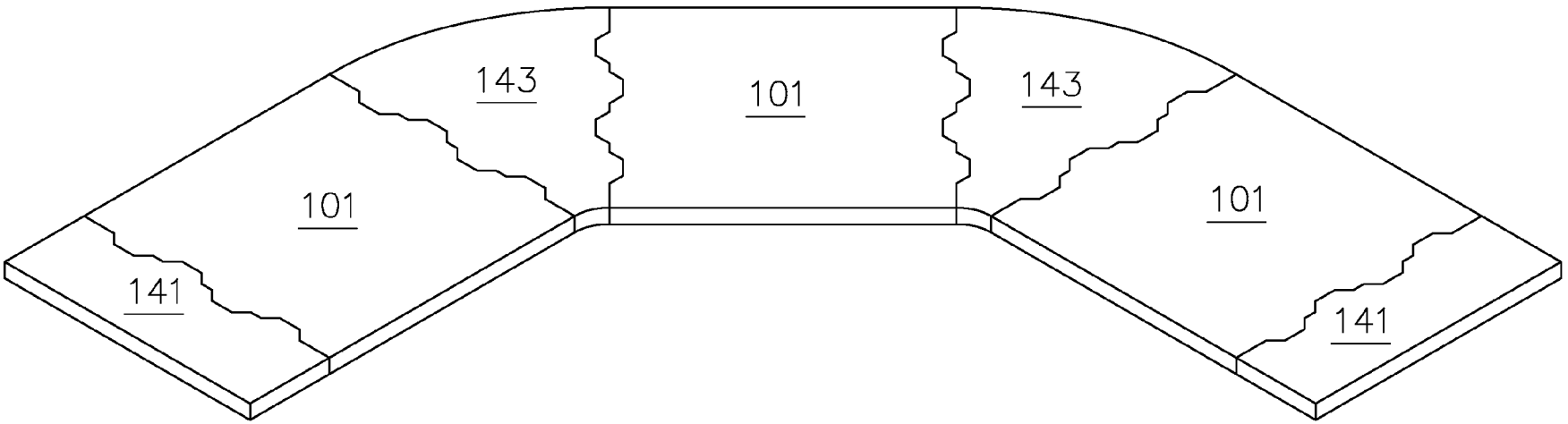
FIG. 16A is a top perspective view of polymeric panels of FIG. 15A customized to form a sidewalk, interlocked together at their edges.

FIG. 16A shows the panels 101/141/143 of FIG. 15A interlocked together at their edges.

Figure 16B:
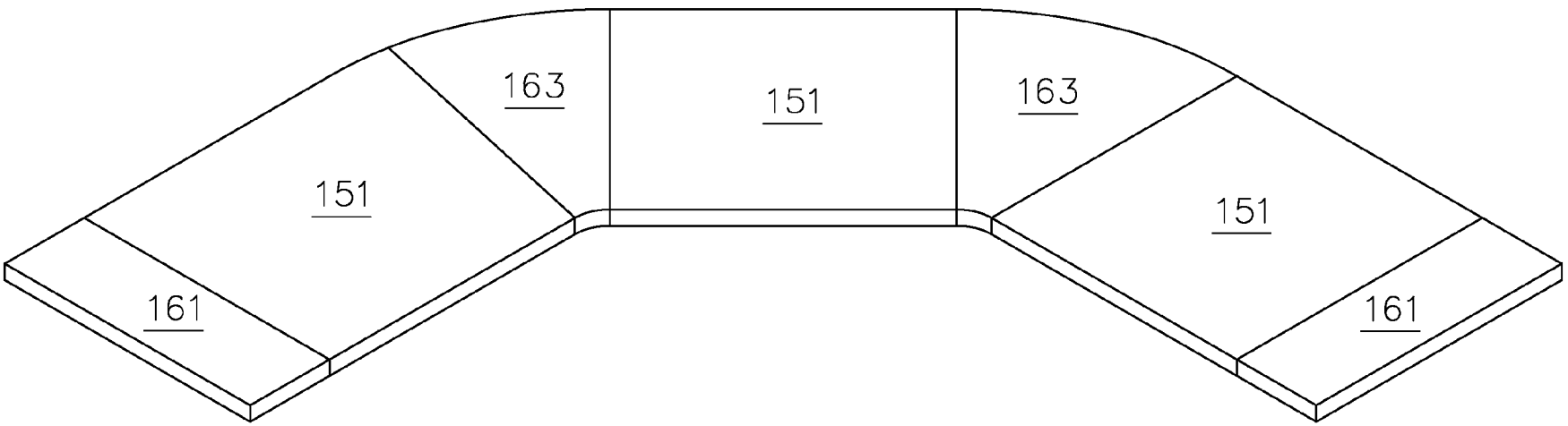
FIG. 16B is a top perspective view of polymeric panels of FIG. 15B with flat interfacing edges customized to form a sidewalk, interlocked together at their edges.

FIG. 16B shows the panels 151/161/163 of FIG. 15B interlocked together at their edges.

Figure 17:
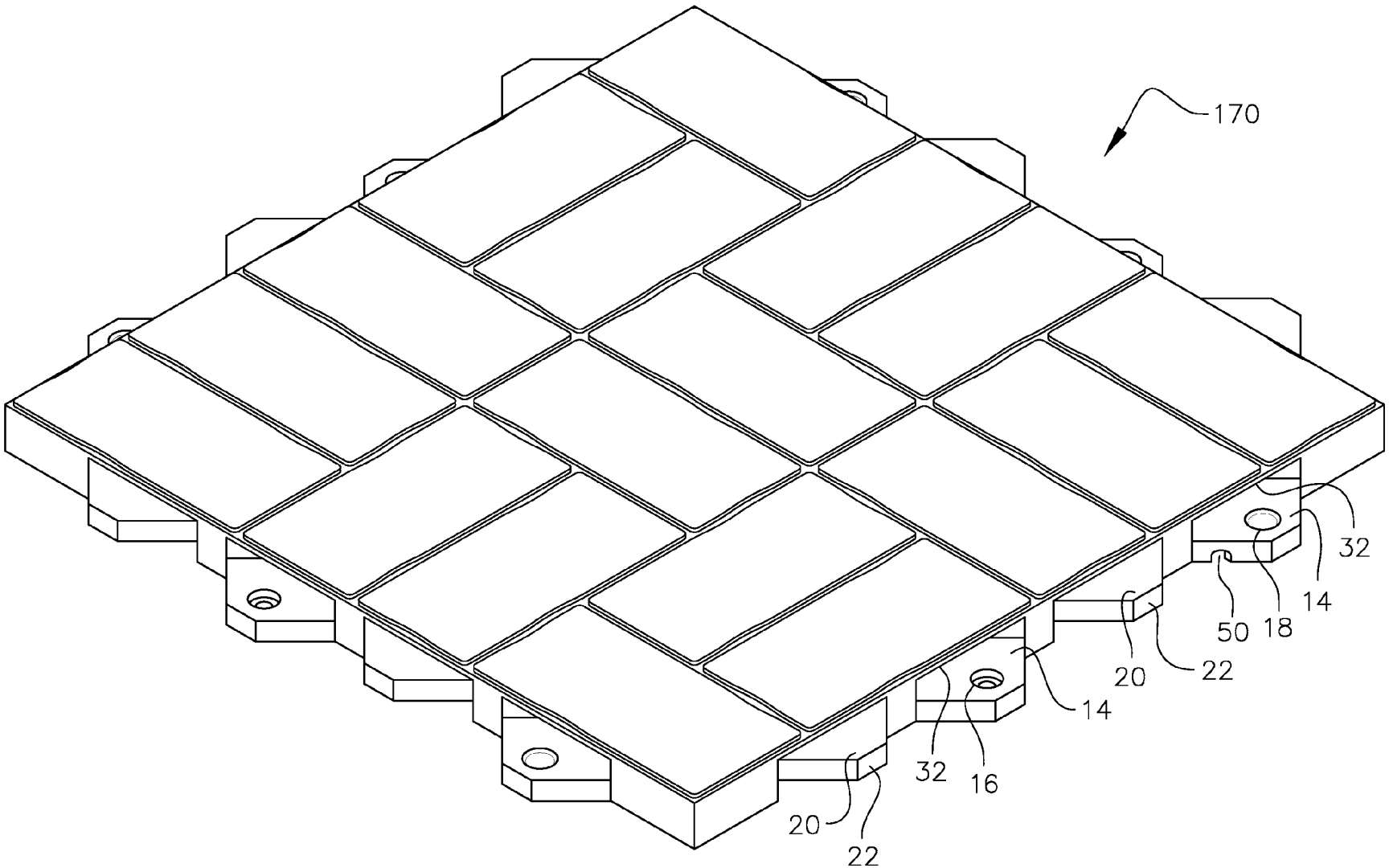
FIG. 17 is a top perspective view of polymeric panels of FIG. 9 with a brick-face decorative top.

FIG. 17 shows the polymeric panels of FIG. 9 with a brick-face decorative top 170. The panels of the present invention are deployable with a plain surface, with a decorative surface as in FIG. 17 or with a covering surface such as carpet, linoleum, vinyl, wood, synthetic wood, tile or artificial turf. FIG. 17 shows a brick-shaped top, one example of the many different decorative tops that are possible with the present invention. It is equally viable to affix a brick facade and grout on top of a panel with a plain, planar surface to achieve a similar look and shape with the feel of real brick.

Figure 18:
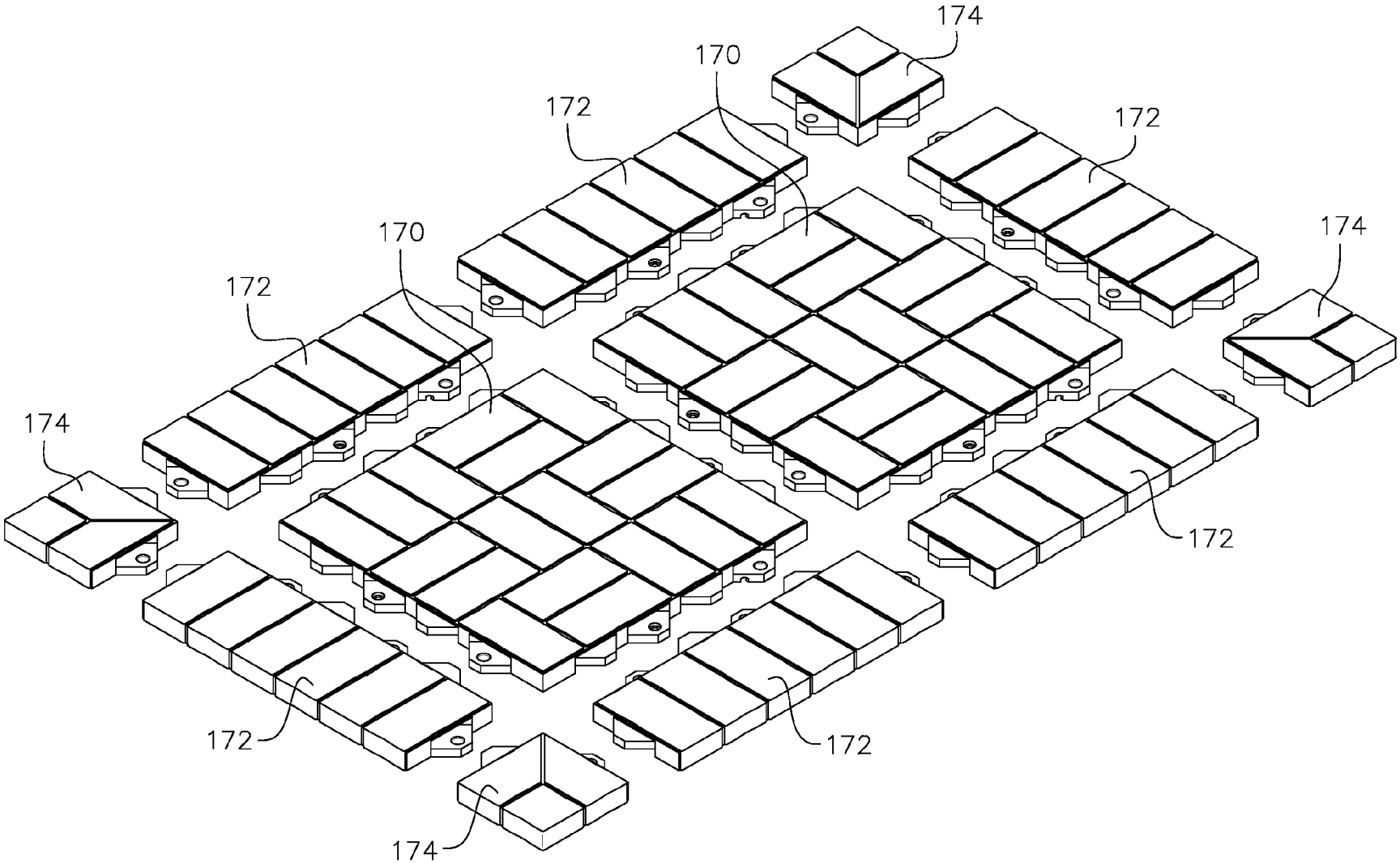
FIG. 18 is a top perspective view of multiple polymeric panels of FIG. 17 along with end-caps, all having a brick-face decorative top and ready to be interlocked.

FIG. 18 shows multiple polymeric panels 170 of FIG. 17 along with end-caps 172/174, all having a molded brick-face decorative top and ready to be interlocked. The end-caps 172/174 utilize the same system to interlock.

Figure 19:
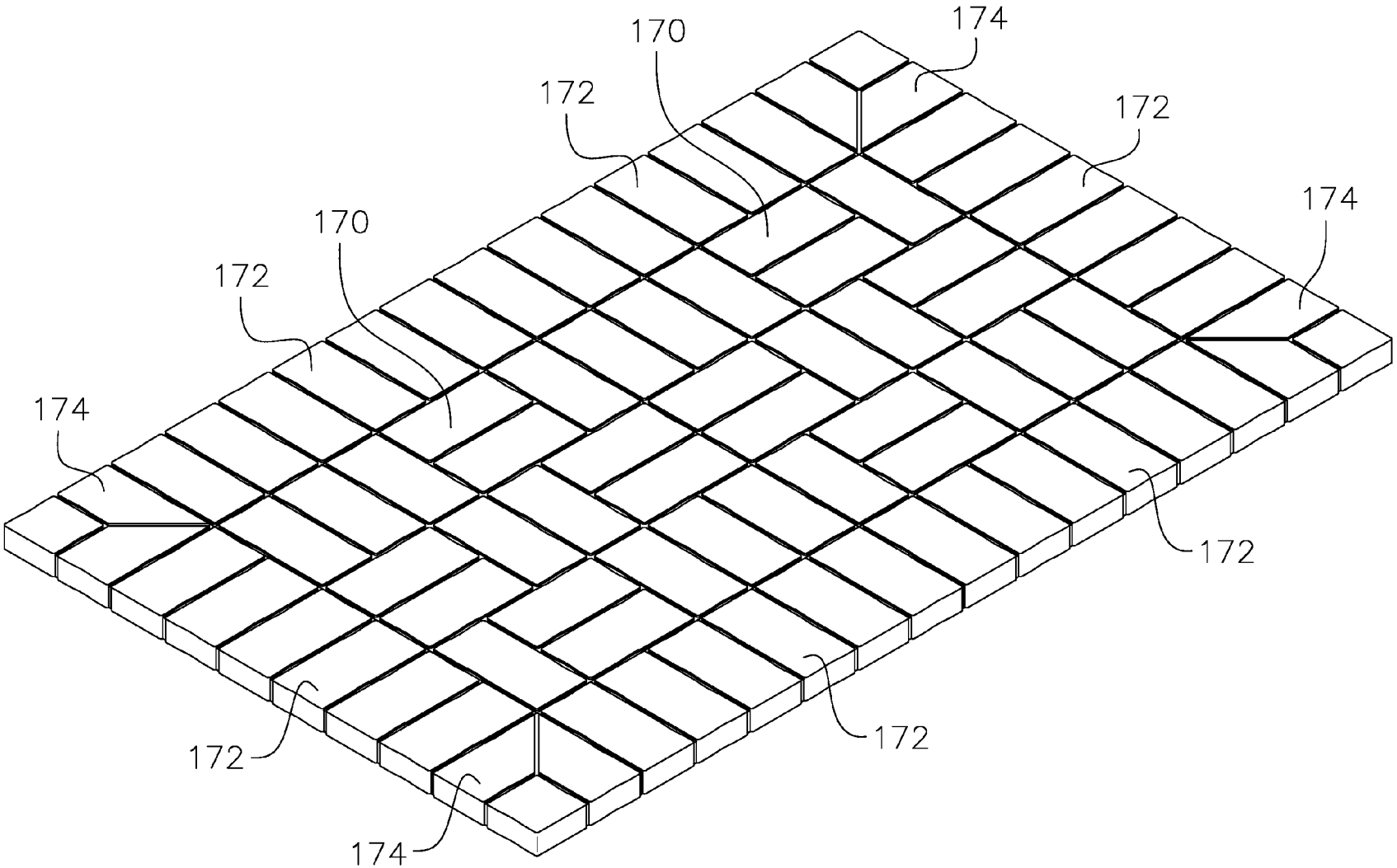
FIG. 19 is a top perspective view of multiple interlocked polymeric panels of FIG. 17 with end-caps, all having a brick-face decorative top.

FIG. 19 shows the multiple polymeric panels 170 and end-caps 172/174 of FIG. 17 interlocked, forming a patio or deck.

Figure 20:
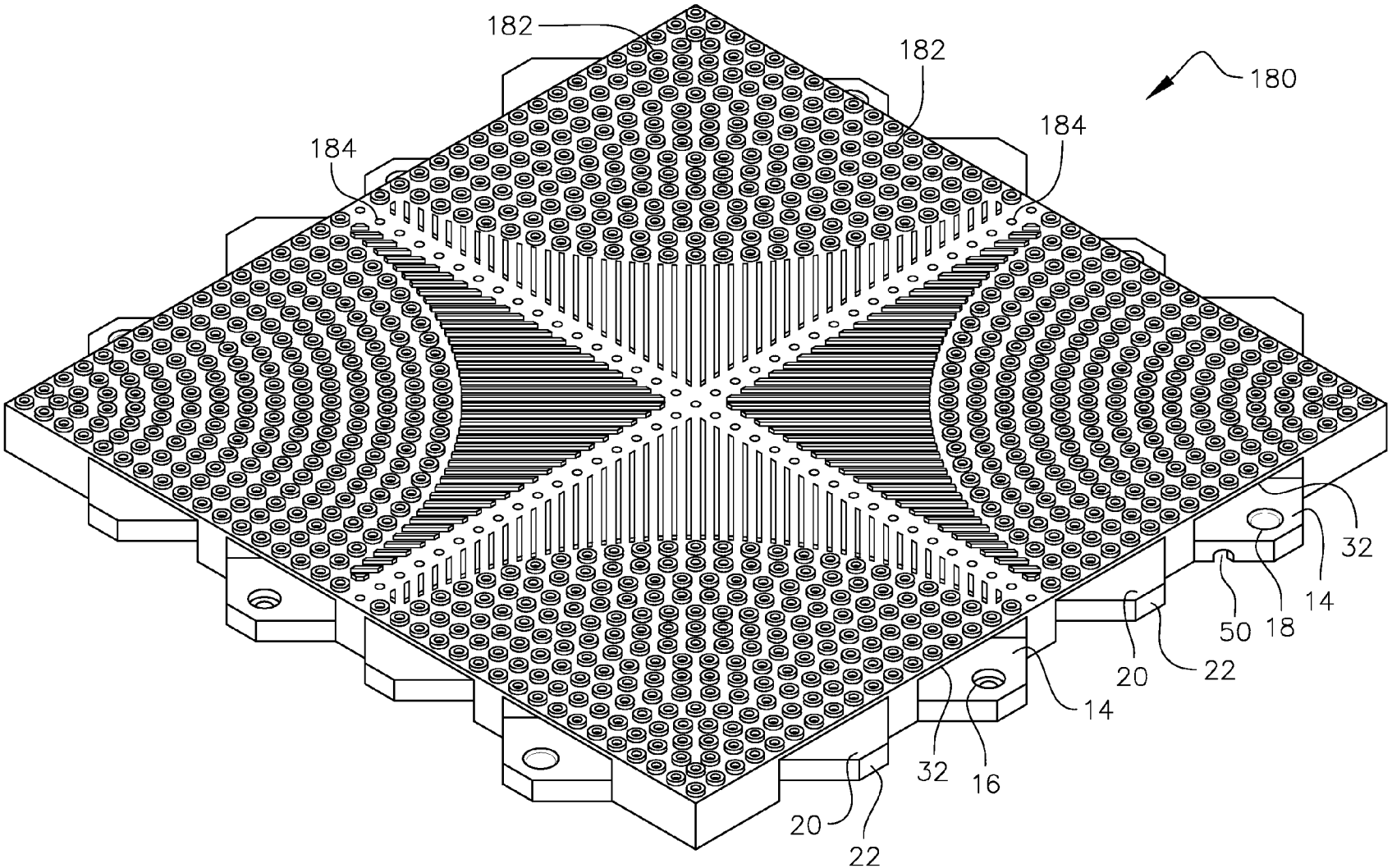
FIG. 20 is a top perspective view of polymeric panels of FIG. 9 with a safety top.

FIG. 20 shows a polymeric panel of FIG. 9 with a safety top having molded projections 182 pointing upward from a top surface. The safety projections 182 are molded into the panel 180 or molded separately and affixed to the top surface of the panel 180 during manufacturing or installation. If the safety surface is molded into the top surface of the panel 180, it is preferred that the panel and/or the safety surface be molded from a non-skid material such as rubber or a rubber-like material. In some embodiments, drain holes 184 are provided to reduce rain-water build-up.

Figure 21:
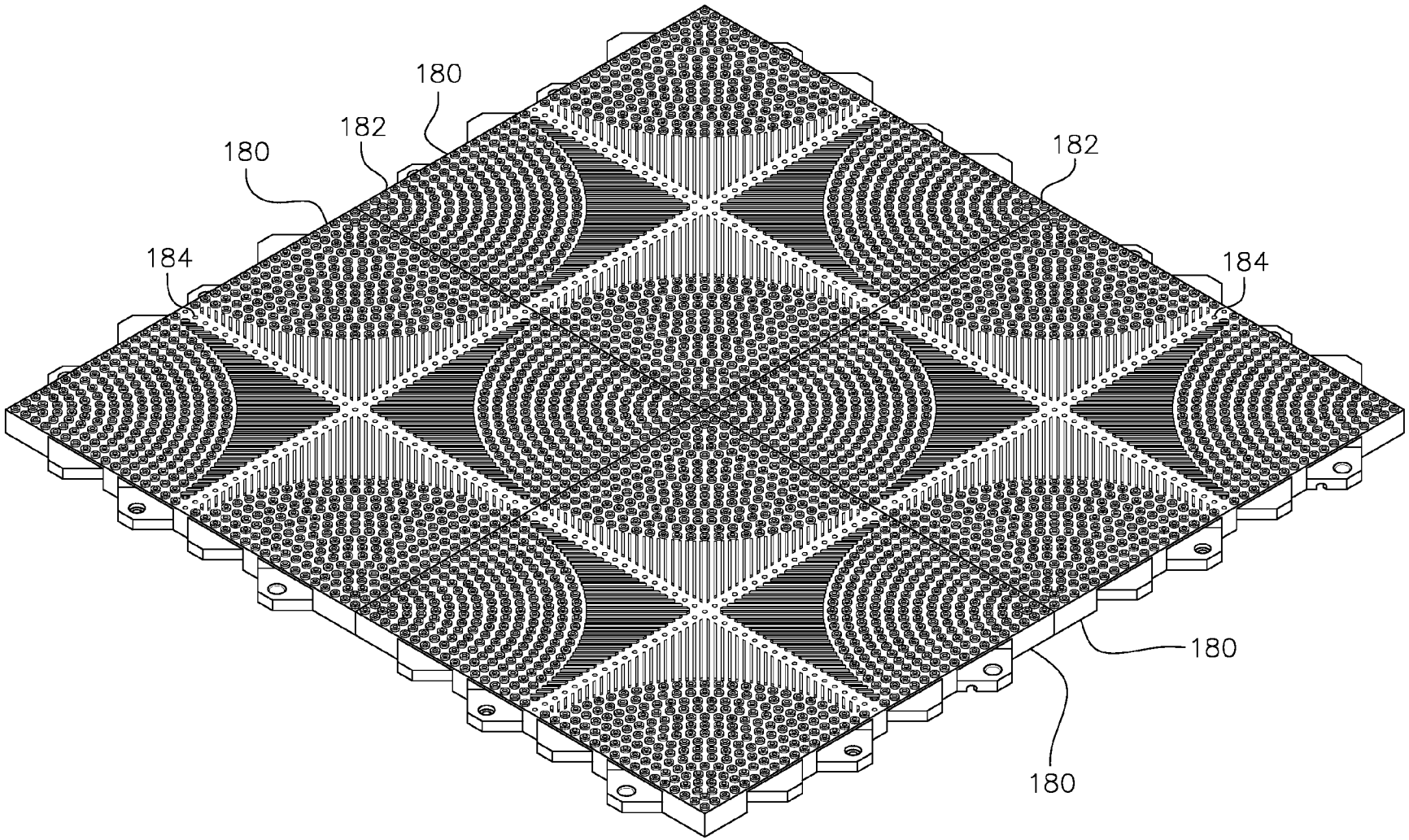
FIG. 21 is a top perspective view of multiple interlocked polymeric panels of FIG. 20 with a safety top.

FIG. 21 shows four interlocked polymeric panels of FIG. 20 with molded projections 182 pointing upward. As shown, when many panels 180 form a safety surface in an area subject to rain or sprinkling, the optional drain holes 184 help prevent water build-up.

In one embodiment, interlocked panels 10 with a synthetic grass covering can be used on driving ranges or practice facility for a golf ball hitting area. The configuration of interlocked panels 10 can be longitudinal, squared, rectangular or other geometric or irregular shape, and can be used, for example, outdoors over grass, dirt or sand or indoors over concrete, ice or plywood or as a substitute for a concrete or plywood base. The interlocked panels 10 can be covered with commercially available surfaces, such as SPORT COURT™ athletic floor tiles, hardwood flooring, synthetic wood floor, carpet or linoleum that are easily installed over the interlocked panels and can be removed and reassembled at alternate locations.

The above description has described specific structural details in applying the invention. However, it will be within one having skill in the art to make modifications without departing from the spirit and scope of the underlying inventive concept of this interlock panel. The invention is not limited to the structure described and includes such modifications as are substantially equivalent to the elements of the interlock panels with or without a surface covering.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes. For example, throughout the description, the convex projection is located on the bottom of the downward facing step and the concave dimple is located on the top of the upward facing step, but the present invention works equally as well with the convex projection located on the top of the upward facing step and the concave dimple on the bottom of the downward facing step.

What is claimed is:

1. An interlocked floor system comprising:

multiple polymeric panels molded as an integral body having a planar top surface and a grid structure supporting the top surface and multiple interlocking side surfaces;

each interlocking side surface having upwardly and downwardly facing steps, at least one of the downwardly facing steps have a convex projection on a bottom surface, at least one of the upwardly facing steps have a concave mating dimple on an upper surface;

an over hang ledge formed as an extension of the planar top surface, thereby forming a cavity between the over hang ledge and the upper surface of each of the upwardly facing steps;

an under hang ledge formed in a top surface of each of the downwardly facing steps allowing each of the downwardly facing steps of a first panel to fit within the cavity of a second panel; and whereas the steps of the side surfaces of the first panel interlock to complementary steps of the second panel, held in place by the convex projections and the mating concave dimples.

2. The interlocked base according to claim 1, wherein the upwardly and downwardly facing steps alternate along the multiple interlocking side surfaces.

3. The interlocked base according to claim 1, wherein the planar top surface is covered with a surface material and the surface material is selected from the group consisting of carpet, linoleum, vinyl, wood, synthetic wood, ceramic tile, plastic tile and artificial turf.

4. The interlocked base according to claim 1, wherein at least one side of the panel is flat.

5. The interlocked base according to claim 1, wherein at least one side of the panel is curved.

6. The interlocked base according to claim 1, wherein at least one of the concave mating dimples further comprises a countersunk hole for accepting an anchor fastener.

7. An interlocked floor comprising:

multiple polymeric panels molded as an integral body having a planar top surface and at least one interlocking side surfaces;

each of the at least one interlocking side surfaces having upwardly and downwardly facing steps, at least one of the downwardly facing steps having a means to interlock on a bottom surface, at least one of the upwardly facing steps having a mating means to interlock on an upper surface;

an over hang ledge formed as an extension of the planar top surface, thereby forming a cavity between the over hang ledge and the upper surface of each of the upwardly facing steps;

an under hang ledge formed in a top surface of each of the downwardly facing steps allowing each of the downwardly facing steps of a first panel to fit within the cavity of a second panel; and whereas the steps of the side surfaces of the first panel interlock with complementary steps of the second panel.

8. The interlocked base according to claim 7, wherein the upwardly and downwardly facing steps alternate along the multiple interlocking side surfaces.

9. The interlocked base according to claim 7, wherein the planar top surface is covered with a surface material and the surface material is selected from the group consisting of carpet, linoleum, vinyl, wood, synthetic wood, ceramic tile, plastic tile and artificial turf.

10. The interlocked base according to claim 7, wherein at least one side of the panel is flat.

11. The interlocked base according to claim 7, wherein at least one side of the panel is curved.

12. The interlocked base according to claim 7, wherein at means to interlock is a convex protrusion and the mating means to interlock is a concave dimple.

13. A flooring system comprising:

a multiplicity of one piece sectional molded polymeric panels, each panel having at least one downwardly facing step and at least one upwardly facing step in a side surface, a planar top surface, and a grid structure supporting the top surface;

at least one of the at least one downwardly facing steps having a convex projection on a bottom surface, at least one of the at least one upwardly facing steps have a concave mating dimple on an upper surface;

an over hang ledge formed as an extension of the planar top surface, thereby forming a cavity between the over hang ledge and the upper surface of each of the upwardly facing steps;

an under hang ledge formed in a top surface of each of the downwardly facing steps allowing each of the downwardly facing steps of a first panel to fit within the cavity of a second panel; and whereas the steps of the side surfaces of the first panel interlock to complementary steps of the second panel.

14. The interlocked base according to claim 13, wherein the upwardly and downwardly facing steps alternate along the multiple interlocking side surfaces.

15. The interlocked base according to claim 13, wherein the planar top surface is covered with a surface material and the surface material is selected from the group consisting of carpet, linoleum, vinyl, wood, synthetic wood, ceramic tile, plastic tile and artificial turf.

16. The interlocked base according to claim 13, wherein at least one side of the panel is flat.

17. The interlocked base according to claim 13, wherein at least one side of the panel is curved.

18. The interlocked base according to claim 13, wherein at least one of the concave mating dimples further comprises a countersunk hole for accepting an anchor fastener.

19. The interlocked base according to claim 13, wherein the planar top surface is molded to simulate the shape of a paving material.

20. The interlocked base according to claim 19, wherein the paving material is brick.

* * * * *